US012593915B2

(12) United States Patent
Geyrhalter

(10) Patent No.: US 12,593,915 B2
(45) Date of Patent: Apr. 7, 2026

(54) STORAGE CABINET

(71) Applicant: Fabian Geyrhalter, Long Beach, CA (US)

(72) Inventor: Fabian Geyrhalter, Long Beach, CA (US)

( * ) Notice: Subject to any disclaimer, the term of this patent is extended or adjusted under 35 U.S.C. 154(b) by 190 days.

(21) Appl. No.: 17/950,819

(22) Filed: Sep. 22, 2022

(65) Prior Publication Data

US 2023/0090629 A1 Mar. 23, 2023

Related U.S. Application Data

(60) Provisional application No. 63/247,311, filed on Sep. 23, 2021.

(51) Int. Cl.
*A47B 88/48* (2017.01)

(52) U.S. Cl.
CPC ..... *A47B 88/48* (2017.01)

(58) Field of Classification Search
CPC ..... A47B 49/004; A47B 88/48; A47F 3/00
USPC ... 312/8.2, 8.3, 8.8, 9.4, 273, 295, 302, 303, 312/305, 325, 9.3, 9.41
See application file for complete search history.

(56) References Cited

U.S. PATENT DOCUMENTS 2,468,662 A * 4/1949 Glendening ..... A47B 11/00 312/334.11
2,564,336 A * 8/1951 Lien ..... A47B 81/067 312/273
2,647,812 A 8/1953 Saunders
2,650,871 A * 9/1953 Holderegger ..... A47B 88/48 16/374
2,876,057 A * 3/1959 Thomas ..... A47B 63/06 312/299
2,936,205 A * 5/1960 Clark ..... A47B 49/004 D15/89
3,063,774 A * 11/1962 Silver ..... A47B 11/00 312/322
5,409,308 A 4/1995 Reuter et al.
6,481,586 B1 11/2002 Hoff
7,832,816 B2 11/2010 Compagnucci
9,801,302 B2 * 10/2017 Huang ..... H05K 7/186
2003/0107305 A1 * 6/2003 Kusztal ..... A47B 21/03 312/265.4
2021/0085100 A1 3/2021 Bersagel et al.

FOREIGN PATENT DOCUMENTS

DE 20 2018 103 969 U1 9/2018

* cited by examiner

*Primary Examiner* — James O Hansen
(74) *Attorney, Agent, or Firm* — Seed Intellectual Property Law Group LLP

(57) ABSTRACT

A storage cabinet includes a housing with a drawer that slides into and out of the housing. A turntable is coupled to the drawer and a tray is disposed on the turntable. A pivot is coupled to the housing and the turntable and includes an extension received in a guide slot of the turntable. The turntable and the tray rotate in response to linear movement of the drawer into and out of the housing via movement of the extension of the pivot along the guide slot of the turntable. The cabinet may also include rolling elements between the turntable and the drawer. An item stored on the tray is rotated as the drawer moves into and out of the housing to enable traditional storage configurations while also allowing users to view different sides of the item based on the position of the drawer.

20 Claims, 17 Drawing Sheets

STORAGE CABINET

BACKGROUND

Technical Field

The present disclosure is directed to a storage cabinet and is particularly, but not exclusively, directed to a storage cabinet with a turntable that rotates in response to linear movement of a drawer of the storage cabinet to enable users to store and view items in the cabinet in different orientations.

Description of the Related Art

Storage cabinets have been known for many years. Conventional storage cabinets can generally be classified as being one of two types, namely static storage cabinets that do not have moving parts, and dynamic storage cabinets that include moving parts. Typical examples of static storage cabinets include bookshelves, crates, and bins, while dynamic storage cabinets may include drawers and doors that move to enable access to a storage space of the cabinet. While known storage cabinets are suitable for some applications, they also suffer from a number of deficiencies.

For example, certain types of items stored in storage cabinets may benefit from organization and presentation to the user that is not achievable with conventional designs. One non-limiting example of this issue is the storage of vinyl records. Vinyl records are packaged in a protective sleeve with a spine and a front surface where the spine includes limited identifying information for the record in the sleeve and the front surface typically includes cover artwork and additional information. Many enthusiasts of vinyl records enjoy browsing for records by looking at the cover artwork on the front surface and flipping through records at retail locations or record shops. However, records in private collections are often stored with only the spine visible. Naturally, arrangement of records with only the spine showing prevents users from enjoying the front cover artwork and eliminates the overall experience of flipping through records when selecting the next record to play. In addition, storage of records with only the spine showing may make it more difficult to locate a desired record. This same issue occurs for other types of commonly stored items as well.

Accordingly, it would be advantageous to have a storage cabinet that overcomes the disadvantages of known storage cabinets.

BRIEF SUMMARY

The present disclosure is generally directed to storage cabinet devices, systems, and methods that rotate an item in the cabinet in response to linear motion to enable users to view two sides of an item. In more detail, a storage cabinet of the type described in the present disclosure may include a housing with a drawer that slides into and out of the housing or a drawer that otherwise moves linearly. A turntable is coupled to the drawer and may include a slot or aperture. A pivot includes a first end rotatably coupled to the housing and a second end with a protrusion or extension that is received in the aperture and coupled to the turntable. As the drawer slides into and out of the housing, the pivot rotates the turntable. A tray for receiving an item may be disposed on the turntable and structured to rotate with the turntable. Further, the cabinet may include rollers, wheels, or bearings between the drawer and the turntable that support a weight of the item and also enable the turntable to rotate about a vertical axis in response to linear movement of the drawer, as described above.

In some non-limiting examples, the storage cabinet, and more particularly, the tray of the storage cabinet, is structured to receive and store vinyl records. The tray may include sides, arms, bookends, or other like structures along selected boundaries of the tray to enable viewing of the records while also keeping the records upright and secured to the tray. The records are placed on the tray with the spines generally facing outward and away from the housing in a traditional configuration when the drawer is received internal to the housing. As the drawer slides out of the housing, the turntable and the tray simultaneously rotate with movement of the drawer until a front surface of the records faces outward and away from the housing when the drawer is fully extended from the housing. This orientation enables a user to view the front surface of the records and flip through records as they would in a record shop.

In view of the above, one or more embodiments of a storage cabinet device may be summarized as including: a housing; a drawer coupled to the housing and configured to slide into and out of the housing; a tray disposed on the drawer; and a pivot coupled to the housing, the pivot having an extension coupled to the tray with the tray configured to rotate in response to movement of the drawer into and out of the housing via movement of the extension of the pivot.

The pivot may further include a first pivot arm rotatably coupled to a second pivot arm with the first pivot arm coupled to the housing and the second pivot arm coupled to the tray.

The first pivot arm may have a length greater than a length of the second pivot arm.

The tray may rotate approximately 90 degrees over a path of travel of the drawer into and out of the housing.

The tray may further include a first arm and a second arm opposite to the first arm, the first arm and the second arm spaced from an interior surface of the housing to accommodate rotational motion of the tray inside the housing.

The storage cabinet may further include a plurality of rolling elements between the pivot and the tray, the plurality of rolling elements including rollers, wheels, or ball bearings.

The drawer may be configured to slide from a retracted position inside the housing to a fully extended position outside the housing in response to only an initial force on the drawer by a user.

One or more embodiments of a storage cabinet device may be summarized as including: a housing; a drawer structured for linear movement relative to the housing; a tray disposed on the drawer; and a pivot coupled to the housing and to the tray, the pivot configured to rotate the tray in response to linear movement of the drawer.

The device may further include a rotation plate between the tray and the drawer, the tray coupled to the rotation plate and the rotation plate coupled to the pivot.

The pivot may include a first pivot arm rotatably coupled to the housing and a second pivot arm rotatably coupled to the first pivot arm with the second pivot arm including an extension coupled to the tray.

The pivot may include an extension coupled to the tray with linear movement of the drawer configured to rotate the tray via movement of the extension.

The device may further include at least one rotation support at an interface between the pivot and the tray, the at least one rotation support including at least one of a roller, a wheel, and a ball bearing.

The tray may include at least one arm with the at least one arm configured to rotate with the tray.

The pivot may be configured to rotate the tray between and including 75 degrees and 105 degrees over a full range of the linear movement of the drawer.

One or more embodiments of a storage cabinet device may be summarized as including: a housing; a drawer coupled to the housing and configured for linear movement; a tray on the drawer; and a pivot including a first link and a second link rotatably coupled to the first link, the first link coupled to the housing and the second link coupled to the tray at a pivot point, the second link further including an extension coupled to the tray and offset from the pivot point with the first link and the second link configured to move relative to each other in response to linear movement of the drawer with movement of the second link changing a position of the extension and generating rotational motion of the tray.

The device may further include a turntable coupled to the drawer, the tray disposed on the turntable and the pivot coupled to the turntable and configured to rotate the turntable in response to linear movement of the drawer.

The drawer may include an aperture and the extension of the second link of the pivot received through the aperture and configured to travel along the aperture in response to linear movement of the drawer.

The pivot may be configured to rotate the tray simultaneously with linear movement of the drawer.

The tray may be configured to receive at least one item with a minor surface of the at least one item facing outward and away from the housing with the drawer received in the housing, and a major surface of the at least one item facing outward and away from the housing in response to the drawer being extended from the housing.

The tray may be configured to rotate inside the housing in response to initial linear movement of the drawer.

Additional embodiments are described in more detail in the following detailed description with reference to the accompanying drawings.

BRIEF DESCRIPTION OF THE SEVERAL VIEWS OF THE DRAWINGS

The present disclosure will be more fully understood by reference to the following figures, which are for illustrative purposes only. These non-limiting and non-exhaustive embodiments are described with reference to the following drawings, wherein like labels refer to like parts throughout the various views unless otherwise specified. The sizes and relative positions of elements in the drawings are not necessarily drawn to scale in some figures. For example, the shapes of various elements are selected, enlarged, and positioned to improve drawing legibility. In other figures, the sizes and relative positions of elements in the drawings are exactly to scale. The particular shapes of the elements as drawn may have been selected for ease of recognition in the drawings. The figures do not describe every aspect of the teachings disclosed herein and do not limit the scope of the claims.

DETAILED DESCRIPTION

Figure 1:
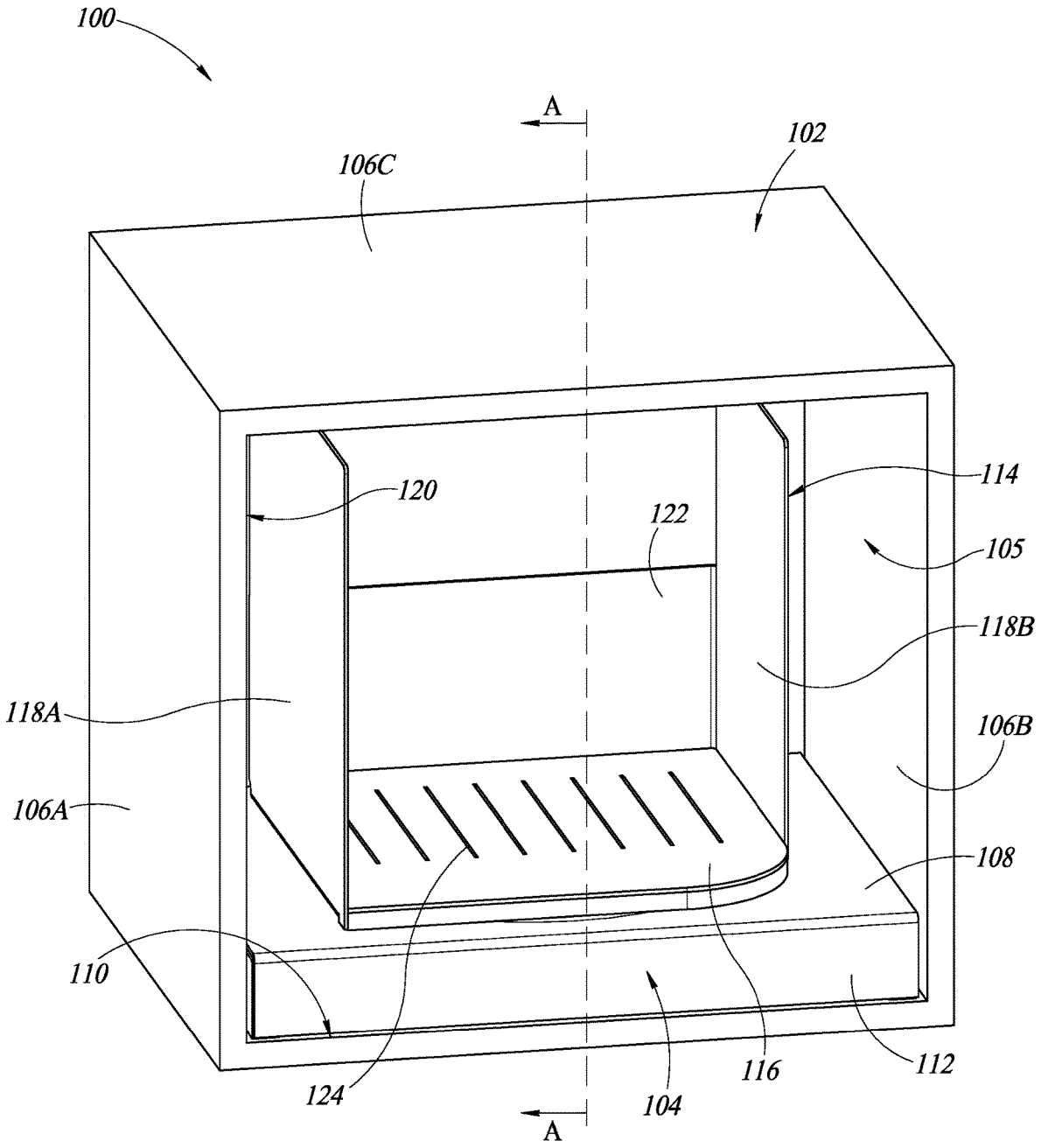
FIG. 1 is an isometric view of an embodiment of a storage cabinet in a retracted position according to the present disclosure.

Persons of ordinary skill in the art will understand that the present disclosure is illustrative only and not in any way limiting. Other embodiments of the presently disclosed systems, devices, and methods readily suggest themselves to such skilled persons having the assistance of this disclosure.

Each of the features and teachings disclosed herein can be utilized separately or in conjunction with other features and teachings to provide storage cabinet devices, systems, and methods. Representative examples utilizing many of these additional features and teachings, both separately and in combination, are described in further detail with reference to the attached Figures. This detailed description is merely intended to teach a person of skill in the art further details for practicing aspects of the present teachings and is not intended to limit the scope of the claims. Therefore, combinations of features disclosed in the detailed description may not be necessary to practice the teachings in the broadest sense, and are instead taught merely to describe particularly representative examples of the present teachings.

Moreover, the various features of the representative examples and the dependent claims may be combined in ways that are not specifically and explicitly enumerated in order to provide additional useful embodiments of the present teachings. It is also expressly noted that all value ranges or indications of groups of entities disclose every possible intermediate value or intermediate entity for the purpose of original disclosure, as well as for the purpose of restricting the claimed subject matter. It is also expressly noted that the dimensions and the shapes of the components shown in the figures are designed to help understand how the present teachings are practiced, but are not intended to limit the dimensions and the shapes shown in the examples in some embodiments. In some embodiments, the dimensions and the shapes of the components shown in the figures are exactly to scale and intended to limit the dimensions and the shapes of the components.

While the following description will describe certain non-limiting examples of a storage cabinet for storing vinyl records, and in particular for storing protective sleeves or covers with vinyl records inside the sleeves, it is to be appreciated that the concepts of the disclosure can be applied equally to the storage of other items and is not limited solely to the storage of vinyl records. In addition, while the following examples of the storage cabinet have a form factor that is generally advantageous for the storage and presentation of vinyl records, the cabinet may be provided in any number of different form factors with the form factor selected for a particular application based on a number of factors, including but not limited to the size, shape, and weight of the item being stored, as well as the desired or beneficial amount of rotation of other movement of the item for organization and presentation of the item in the storage cabinet.

FIG. 1 is a front isometric view that shows an embodiment of a storage cabinet 100 in a retracted position according to the present disclosure. The storage cabinet 100 includes a housing 102 that may be provided in a variety of form factors, including but not limited to, a cube, or another square or rectangular shape, among many others. A drawer 104 is coupled to the housing 102 and is configured to slide into and out of the housing 102, as described further below. In an embodiment, the drawer 104 is coupled to opposing left and right sidewalls 106A, 106B of the housing 102 via drawer slide assemblies with a main body 108 of the drawer 104 positioned spaced from a bottom interior surface 110 of the housing 102 by the drawer slide assemblies. Further, the housing 102 includes additional sidewalls 106C at the top, bottom, and rear of the housing 102 that are coupled to the opposing left and right sidewalls 106A, 106B to provide a hollow space 105 that is open on the front side of the housing 102, as shown in FIG. 1, to enable the drawer 104 to slide into and out of the housing 102. The main body 108 may be provided in a form factor of a generally flat and planar plate that terminates in an end face 112 that extends perpendicularly from the main body 108 toward the bottom interior surface 110 of the housing 102. In an embodiment, the end face 112 is in contact with, or in close proximity to (i.e., less than 0.25 inches in this context only), the bottom interior surface 110 of the housing 102.

The storage cabinet 100 further includes a tray 114 that is rotatably coupled to the drawer 104. As will be described in further detail below, the tray 114 is structured to accommodate one or more items and is further configured to rotate in response to linear movement of the drawer 104 into and out of the housing 102. The one or more items received in the tray 114 may be vinyl records, or more specifically, sleeves that contain and protect vinyl records, in a preferred embodiment. However, and as noted above, the one or more items may be any selected item in some embodiments. The tray 114 includes a base 116 and a pair of arms 118A, 118B coupled to the base 116. A first arm 118A is opposite to a second arm 118B across the base 116 and each of the arms 118A, 118B may be spaced from an interior surface 120 of the sidewalls 106A, 106B, 106C of the housing 102. In an embodiment, the arms 118A, 118B are spaced from at least an interior surface 120 of the opposing left and right sidewalls 106A, 106B of the housing 102 to enable rotation of the arms 118A, 118B inside the housing 102 during rotation of the tray 114 in response to movement of the drawer 104.

The tray 114 further includes a back wall 122 that may be coupled to the base 116 or the arms 118A, 118B, or any combination thereof. In an embodiment, the back wall 122 has a height relative to the base 116 that is less than a height of the arms 118A, 118B and may in some examples be less than half the height of the arms 118A, 118B. In some embodiments, the arms 118A, 118B and the back wall 122 each have the same or different heights. Further, the base 116 of the tray 114 may generally be flat and planar, except the base 116 can include notches 124. The notches 124 may be provided in the form of a series of continuous rectilinear recesses in the base 116 that are each spaced equidistant from each other across the base 116 and generally extend from the back wall 122 toward the front of the base 116. Many other variations are possible, including a series of discontinuous and irregular shaped recesses with a selected spacing, as well as small protrusions (i.e., bumps, ridges, and the like), or any combination thereof, among others. In operation, the arms 118A, 118B and the back wall 122 assist with holding the one or more items in the tray 114 during operation of the storage cabinet 100.

Figure 2:
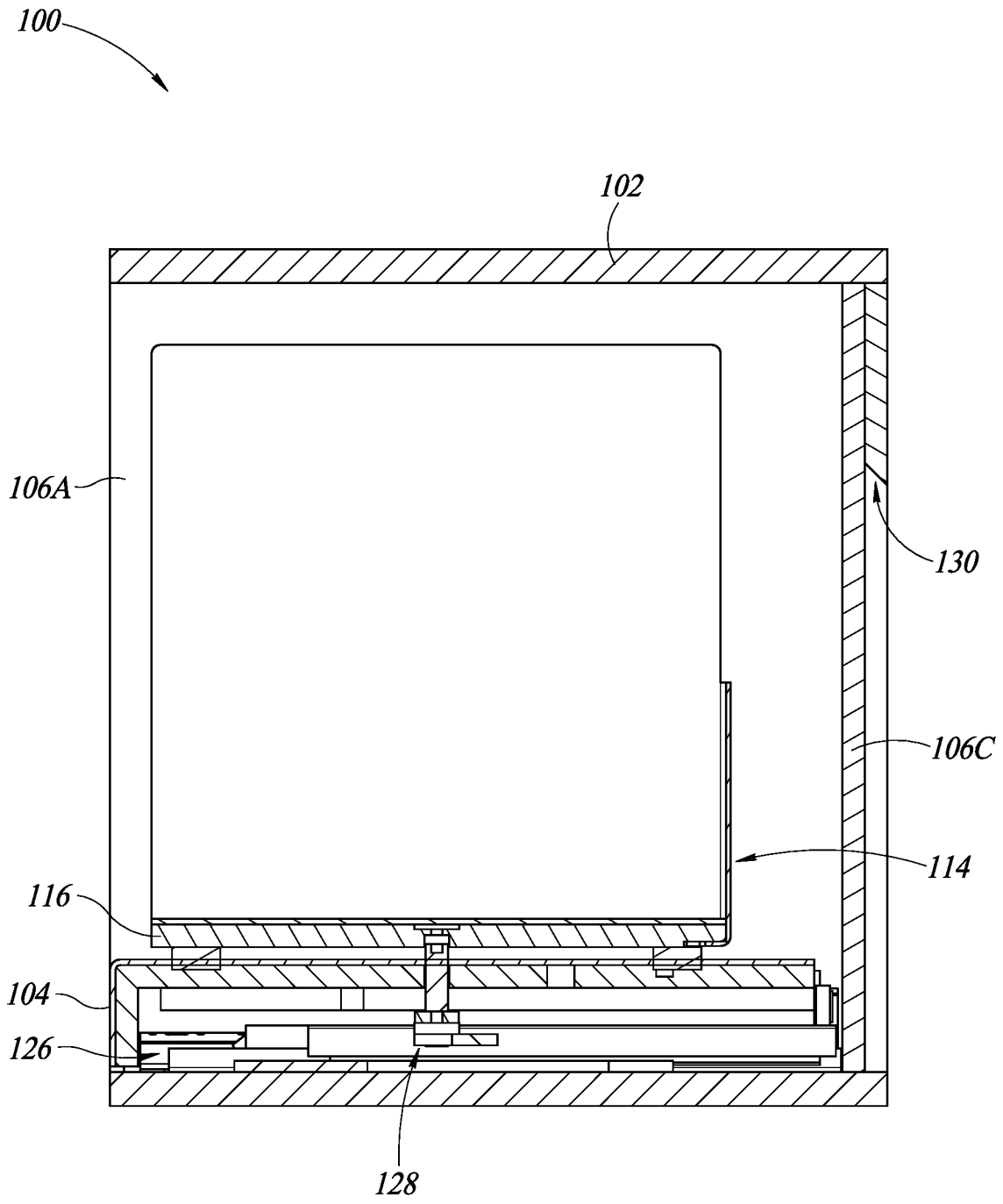
FIG. 2 is a cross-sectional view of the storage cabinet of FIG. 1 along line A-A in FIG. 1.

FIG. 2 is a cross-sectional view of the storage cabinet 100 along line A-A in FIG. 1. As noted above, the drawer 104 is coupled to sidewalls 106A, 106B of the housing 102 with drawer slide assemblies 126, which may be soft-close drawer slide assemblies of a conventional type and configuration in some embodiments. The base 116 of the tray 114 is coupled to the drawer 104 at least in part by a pivot 128 that will be described in greater detail with reference to at least FIGS. 4A-4C and FIG. 5. The housing 102 further includes a groove 130 in a rear or back sidewall 106C of the housing 102 that is configured to mate with a corresponding structure mounted on a wall or other support structure to enable mounting of the storage cabinet 100 to the wall or other support structure. In an embodiment, the housing 102 sits flush with the wall or other support structure to improve the overall aesthetics of the storage cabinet 100. Further, the cube, square, or rectangular shape of the housing 102 in some embodiments may enable multiple storage cabinets 100 to be mounted adjacent and in contact with each other, such as in an array of storage cabinets 100 including one or more rows and/or columns of storage cabinets 100. In other words, the cabinet 100 is modular such that multiple cabinets 100 can be joined together by stacking on top or below each other and/or by linking side-by-side. The cabinets 100 may also be integrated as a part of other furniture. Such an arrangement increases storage capacity, while also providing a desirable aesthetic for storage of items.

Figure 3A:
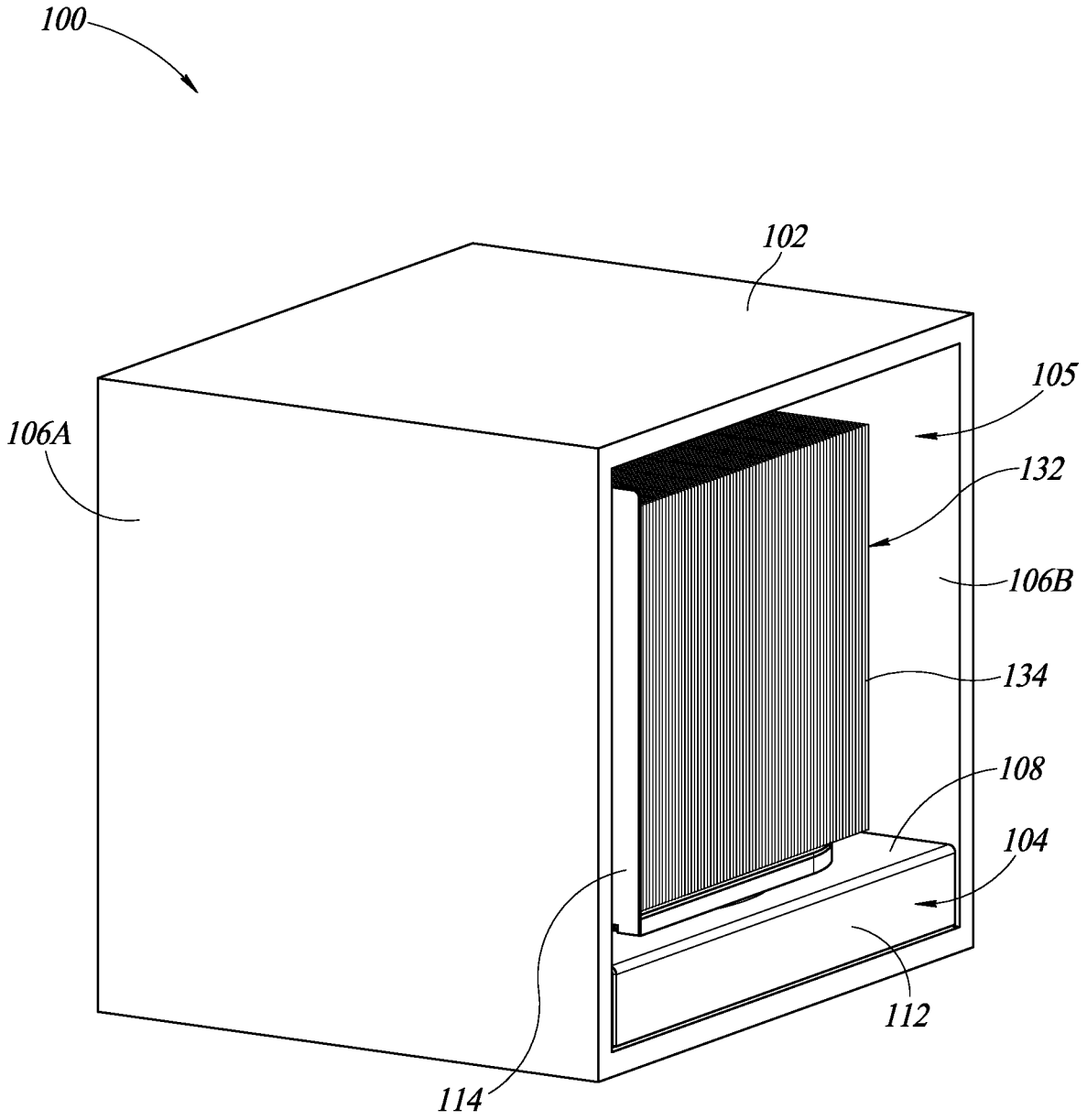
FIGS. 3A-3C are isometric views of the storage cabinet of FIG. 1 illustrating rotation of a tray of the cabinet in response to linear movement of a drawer of the cabinet from the retracted position of the cabinet to an extended position of the cabinet.
Figure 3B:
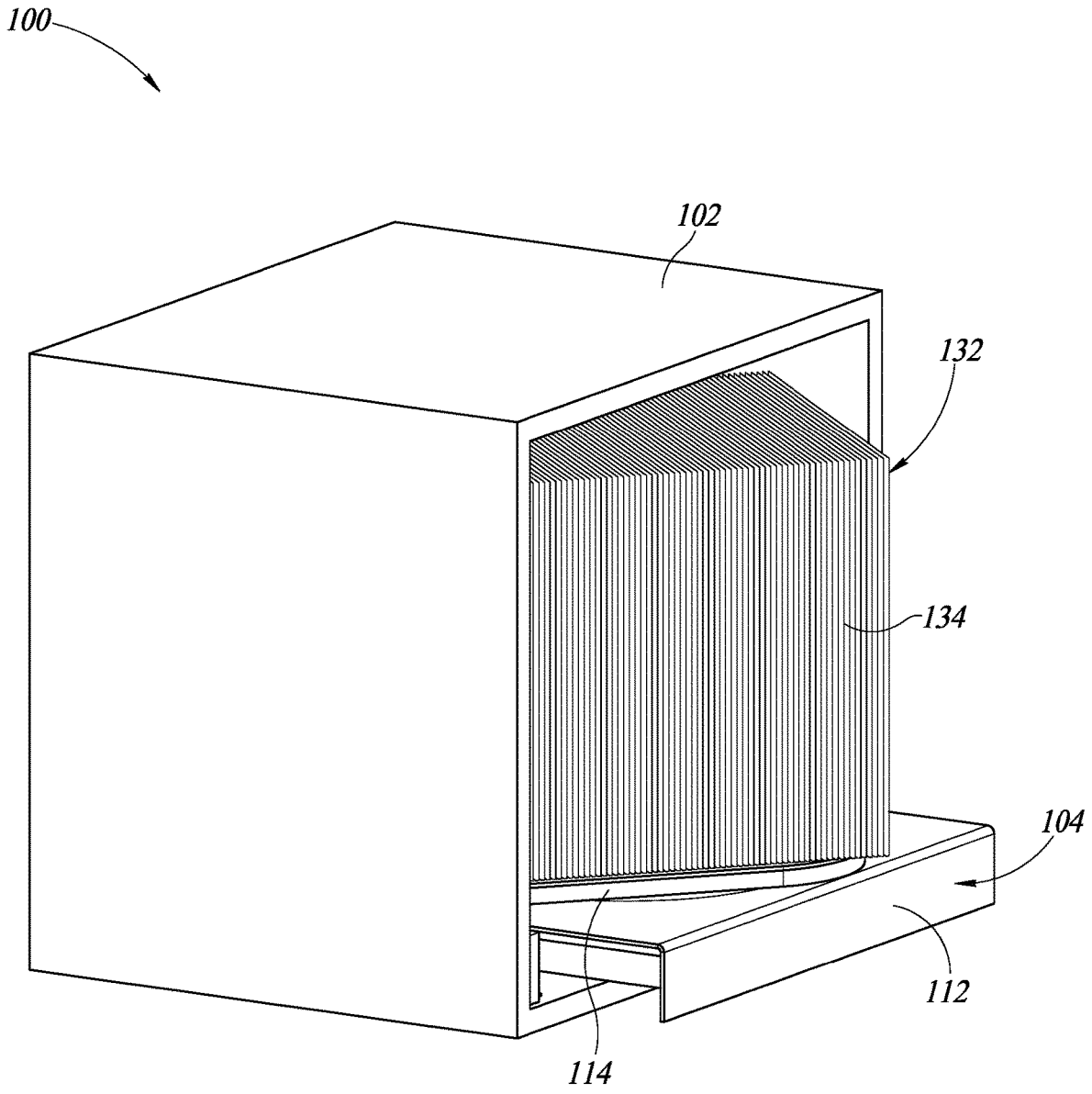
Figure 3C:
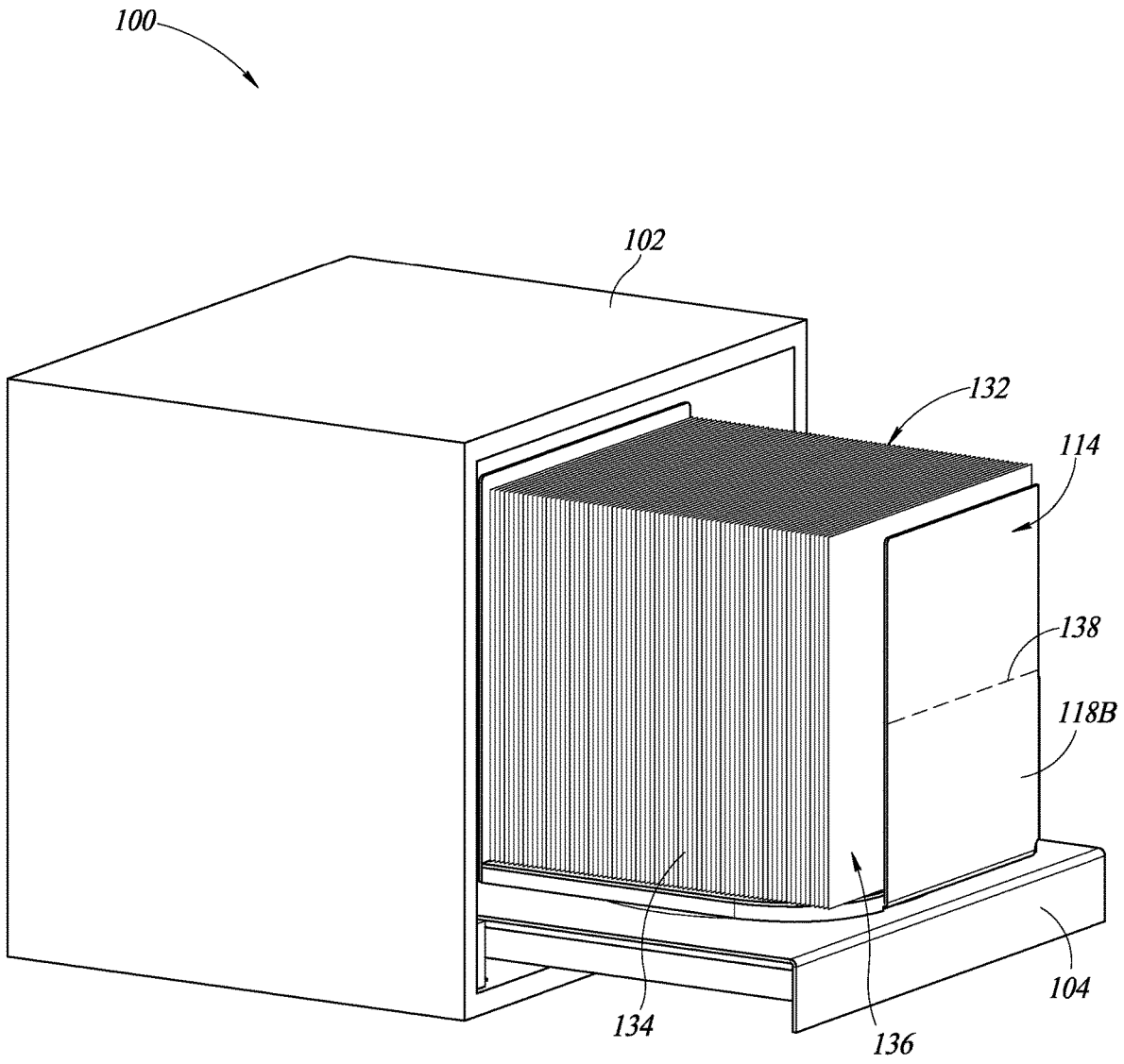

FIGS. 3A-3C show rotation of the tray 114 of the cabinet 100 in response to linear movement of the drawer 104 from the retracted position shown in FIG. 1 and FIG. 3A to an extended position shown in FIG. 3C, as well as the corresponding rotation of the one or more items received on the tray 114.

Beginning with FIG. 3A, the cabinet 100 is shown in the retracted position (similar to FIG. 1) with the drawer 104 received completely within the housing 102, meaning that the body 108 of the drawer 104 is received inside the space 105 in the housing 102 with the end face 112 of the drawer 104 planar with, or recessed with respect to, an outer surface of the opposing left and right sidewalls 106A, 106B of the housing 102. One or more items 132 are received on the tray 114 and are likewise positioned inside the housing 102. In the retracted position shown in FIG. 3A, a first side 134 of each of the items 132 faces outward and away from the housing 102. The first side 134 may be a spine of a sleeve for a record in some embodiments. In further embodiments, the first side 134 may be a minor surface of the one or more items 132, meaning a surface with a surface area smaller than at least one other major side.

In operation, and turning to FIG. 3B, a user pushes on the end face 112 of the drawer 104 to release the drawer slides 126 (FIG. 2). The drawer slides 126 (FIG. 2) may store mechanical energy (such as through springs, rollers, and the like) in some embodiments that cause the drawer 104 to slide out of the housing 102 in response to the initial pressing force provided by the user. More specifically, FIG. 3B illustrates the drawer 104 in a position between the retracted position shown in FIG. 3A and the fully extended position shown in FIG. 3C where the tray 114 has begun to rotate following the application of the initial pressing force on the end face 112 of the drawer 104. In embodiments where the drawer slides 126 do not include energy storage functionality, the drawer 104 may also include a pull, or some other such structure for enabling a user to apply a continuous pulling force (i.e., longer in duration than the initial pressing force) to extend the drawer 104 and rotate the tray 114. As the drawer 104 begins to slide out of the housing 102, the tray 114 begins to rotate in conjunction with linear movement of the drawer 104. As shown in FIG. 3B, at least a portion of, or all of, the tray 114 is configured to rotate inside the housing 102 in response to the initial movement of the drawer 104 out of the housing 102. Such rotation is enabled at least in part by the spacing of the tray 114 from the sidewalls 106A, 106B, 106C (FIG. 1) of the housing 102, as described herein.

Turning to FIG. 3C, the storage cabinet 100 and the drawer 104 are shown in the fully extended position. In this position, the drawer 104 extends from the housing 104 by a maximum amount that may correspond to a maximum range of the drawer slides 126 (FIG. 2). Further, the tray 114 has completed a 90 degree rotation in response to the movement of the drawer 104, in some embodiments. Such rotation of the tray 114 orients a major surface 136 of the one or more items 132 accommodated in the tray 114 facing outward and away from the housing 104 when the drawer 104 is extended from the housing 104. The major surface 136 may be a surface of the one or more items 132 with the largest surface area relative to other minor surfaces of the one or more items 132. In an embodiment where the one or more items are record sleeves, the first side or minor surface 134 may be a spine that contains certain identifying information, while the major surface 136 is a front or rear cover that may contain artwork, song listings, and other characteristics. The rotation of the tray 114 aligns the major surface 136 in a direction that faces a user, such that the user may flip through the records and view the cover artwork or other information, similar to how a customer would view records in a record shop. At the same time, when the drawer 104 is retracted back into the housing 104 by a force from a user, the records are stored in the fully retracted position in a traditional orientation with the spines (i.e., first side or minor surface 134) facing outward. As a result, the storage cabinet 100 enables both traditional storage configurations as well as the ability for users to flip through records in an enjoyable manner and more quickly select the record they wish to play based on the information provided on the major surface 136.

In some embodiments, the second or right arm 118B faces outward and toward the user in the fully extended position of the storage cabinet 100 and drawer 104. The second or right arm 118B may have a height that is less than a height of the first arm 118A (FIG. 1) to enable a user to more easily view the major surface 136. Such a reduced height of the second arm 118B is illustrated schematically in FIG. 3C by dashed line 138. The height of the second arm 118B may be the same, greater than, or less than, the height of the back wall 122 of the tray 114 (FIG. 1) while also being less than the height of the first arm 118A (FIG. 1).

As noted above, the drawer 104 and the storage cabinet 100 can be returned to the retracted position of FIG. 3A by reversing the process above, namely, the user applies a force to the drawer, such as to the end face 112, to push the drawer 104 back into the housing 102 until the drawer slides 126 (FIG. 2) engage. This restoring force provided by the user also stores mechanical energy in the drawer slides 126 (FIG. 2), such as by loading springs, rollers, and the like in the drawer slides (FIG. 2), so that the drawer 104 is ready to be released by a subsequent initial pressing force at a later instance in time.

Figure 4A:
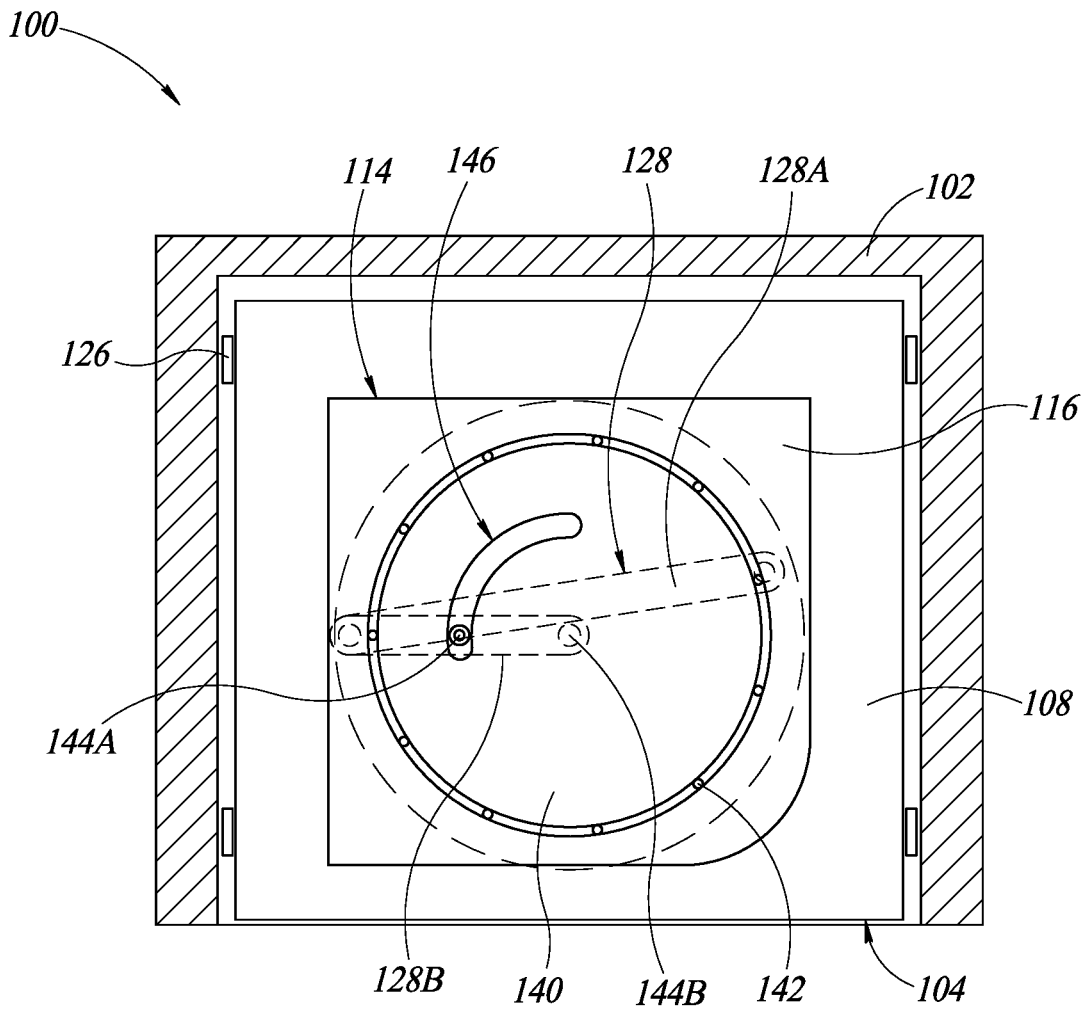
FIGS. 4A-4C are schematic views of the storage cabinet of FIG. 1 illustrating a pivot of the cabinet rotating the tray in response to linear movement of the drawer.
Figure 4B:
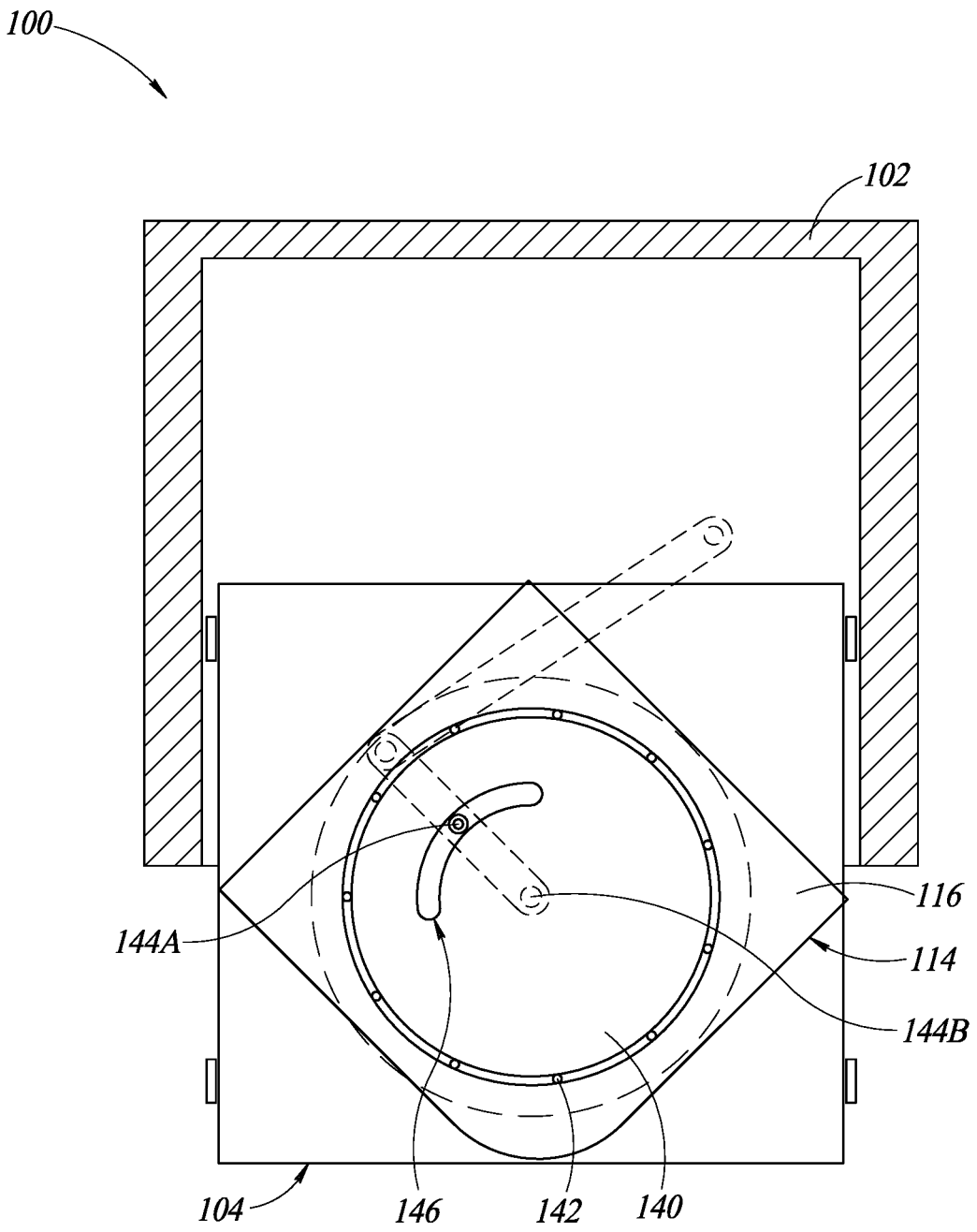
Figure 4C:
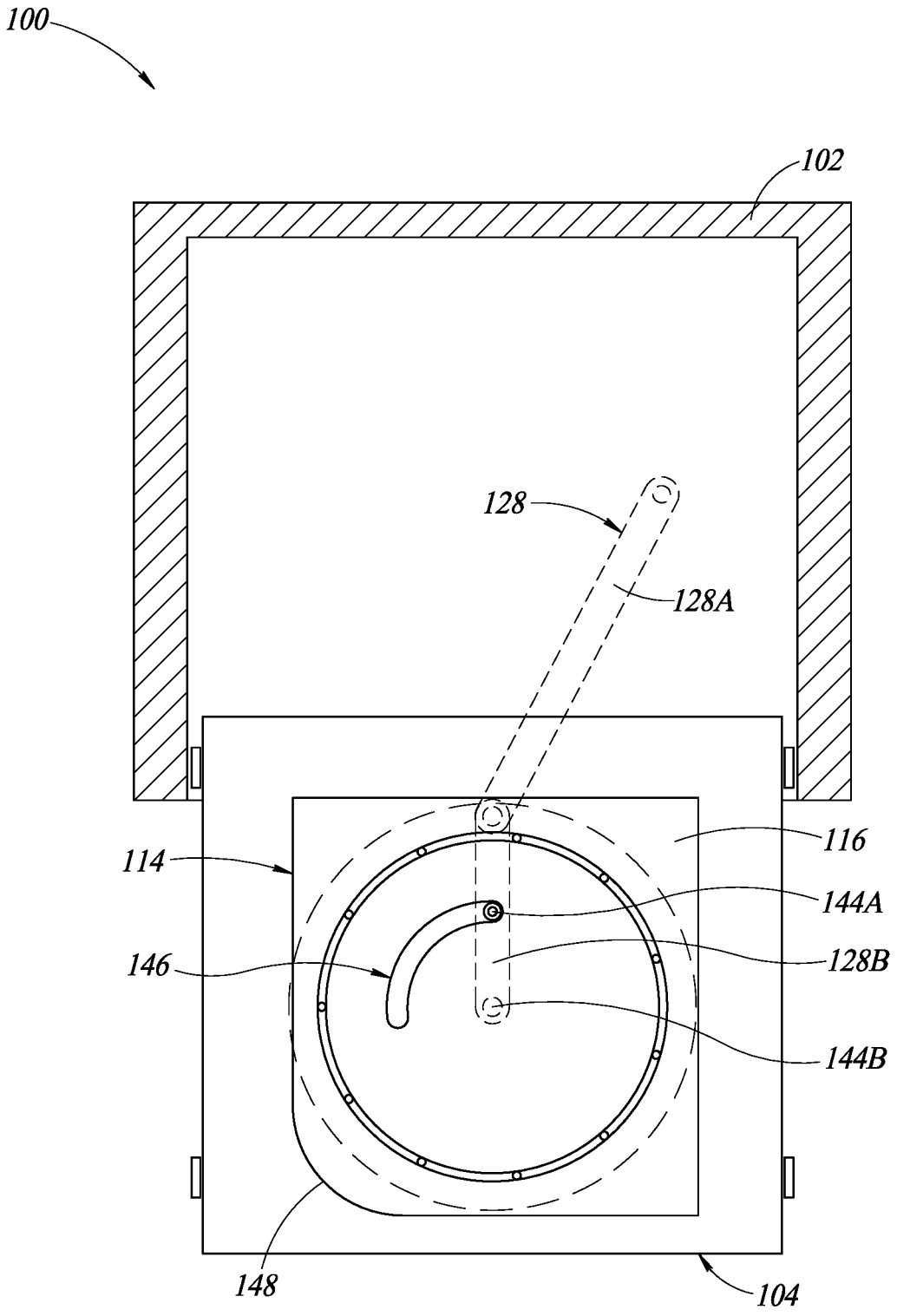

FIGS. 4A-4C are schematic views of the storage cabinet 100 illustrating operation of the pivot 128 (FIG. 2) to rotate the tray 114 in response to linear movement of the drawer 104. In particular, FIGS. 4A-4C correspond to the operation of the storage cabinet 100 shown in FIGS. 3A-3C, with FIG. 4A corresponding to the retracted position in FIG. 3A, FIG. 4B corresponding to the mid-extension position in FIG. 3B, and FIG. 4C corresponding to the fully extended position of FIG. 3C.

Beginning with FIG. 4A, the storage cabinet 100 includes a turntable 140 coupled to the drawer 104 and configured to rotate with respect to the drawer 104. The cabinet 100 may include one or more, or a plurality of, rotation supports 142 (which may also be referred to herein as rolling elements 142) between the turntable 140 and the drawer 104 to reduce friction associated with rotation of the turntable 140 with respect to the drawer 104. The rotation supports 142 may include one and/or at least two rings, rollers, wheels, bearings, or ball bearings in some embodiments. The base 116 of the tray 114 sits on, and may be coupled to, the turntable 140. As a result, the tray 114 rotates in response to rotation of the turntable 140, and vice versa.

The pivot 128 will be described in more detail with reference to FIG. 5, but briefly, the pivot 128 may include a first pivot arm 128A and a second pivot arm 128B that are rotatably coupled to each other. The first pivot arm 128A is coupled to the housing 102 and the second pivot arm 128B is coupled to the turntable 140. The second pivot arm 128B may include a first extension 144A and a second extension 144B. The first extension 144A is received in through an aperture 146 in the turntable 140 and is coupled to the turntable 140. The second extension 144B is rotatably coupled to a central pivot point on an underside of the turntable 140. As shown in FIG. 4A, the aperture 146 in the turntable 140 may have a shape that corresponds to movement of the first extension 144A along a rotation range of the tray 114. In some embodiments, such shape is a curve that extends approximately 90 degrees (i.e., between 85 degrees to 95 degrees) to allow for movement of the first extension 144A in response to rotation of the tray 114 a corresponding amount, namely 90 degrees or approximately 90 degrees. In an embodiment, the aperture 146 may have a different selected shape to allow for movement of the first extension 144A. Further, ends of the aperture 146 may limit over rotation through contact with the first extension 144A. In the retracted position shown in FIG. 4A, the pivot arms 128A, 128B may at least partially overlap each other in some embodiments.

Turning to FIG. 4B, when the user provides the initial force to release the drawer slides 126 and the drawer 104 begins to extend from the housing 102, the arms 128A, 128B (FIG. 4A) of the pivot 128 begin to extend and unfold due to the coupling of the second extension 144B to the turntable 140 and/or drawer 104 and the rotational coupling between the arms 128A, 128B, which causes the first extension 144A to change position and move along the aperture 146. Because the first extension 144A is coupled to the turntable 140, but offset from the central pivot corresponding to the second extension 144B, the change in position of the first extension 144A results in rotation of the turntable 140. In other words, the turntable 140 and the tray 114 rotate in response to movement of the first extension 144A of the second arm 128B of the pivot 128 in response to linear movement of the drawer 104 that causes movement or extension of the arms 128A, 128B of the pivot 128.

As noted above, rotation of the turntable 140 produces rotation of the tray 114 and thus, rotation of the one or more items 132 on the tray described with reference to FIG. 3A-3C. In an embodiment, the first extension 144A may include a roller, bearing, protective coating, or some other like structure to reduce friction between the first extension 144A and the walls of the turntable 140 that define the aperture 146. Further, the rotation supports 142 may reduce the friction associated with the rotation of the turntable 140 to enable the drawer 104 to extend, and the tray 114 to rotate, in response to only the initial pressing force provided by the user and the mechanical energy stored in the drawer slide assemblies 126.

Finally, in FIG. 4C, the storage cabinet 100 and the drawer 104 are shown in the fully extended position. In this position, the first extension 144A of the second arm 128B of the pivot 128 has reached an opposite end of the aperture 146 and therefore has completed its path of travel along the aperture 146. In addition, and as shown in FIGS. 4A-4C the arms 128A, 128B of the pivot 128 move from an at least partially overlapping position in FIG. 4A to a fully extended position without any overlap in FIG. 4C to accommodate the linear movement of the drawer 104 from the retracted to the fully extended position. In the fully extended position of the pivot 128, an angle between the pivot arms 128A, 128B may be greater than 90 degrees and less than 180 degrees. The base 116 of the tray 114 may also have at least one curved portion 148 (or at least one corner that is curved). The rotation of the tray 114 is shown schematically in FIGS. 4A-4C by the rotation of the curved portion 148 of the base 116 of the tray 114. The tray 114 completes a 90 degree rotation, as shown by the change in position of the curved portion 148, to position the major surface 136 of the one or more items 132 (FIG. 3C) away from the housing 102 and toward the user.

In an embodiment, the aperture 146 may be a curve that extends more or less than 90 degrees, or may have a different shape that allows for movement of the first extension 144A over the full range of linear movement of the drawer 104. In some non-limiting examples, the linear movement of the drawer 104 may result in a 45 degree and/or 75 degree rotation of the tray 114, and the aperture 146 may have a similar shape accordingly. Still further, the linear movement of the drawer 104 may result in a 105 degree and/or 135 degree and/or 180 degree rotation of the tray 114. The shape of the aperture 146 and rotation of the tray 114 may also be selected within a range, such as between and including 75 degrees and 105 degrees, including all intervening values. Many other variations are possible and contemplated herein.

In some embodiments, the turntable 140 may be a separate structure from the drawer 102 and the tray 114. Alternatively, the turntable 140 may be formed as an integral part of the tray 114 that is mounted to the drawer 104 with the rotation supports 142 therebetween, or as an integral part of the drawer 104 with the tray 114 mounted on the combination. In yet further embodiments, the turntable 140 may be omitted and the tray 114 is configured to interface with the rotation supports 142 and rotate directly on the drawer 104 without a separate turntable. In view of the above, the pivot 128 enables simultaneous rotation of the tray 114 in response to linear movement of the drawer 104 into and out of the housing 102 to provide at least some of the advantages described herein. The amount of rotation of the tray 114 may generally correspond to the amount of linear movement of the drawer 104 with respect to the housing 102 in some embodiments.

Figure 5:
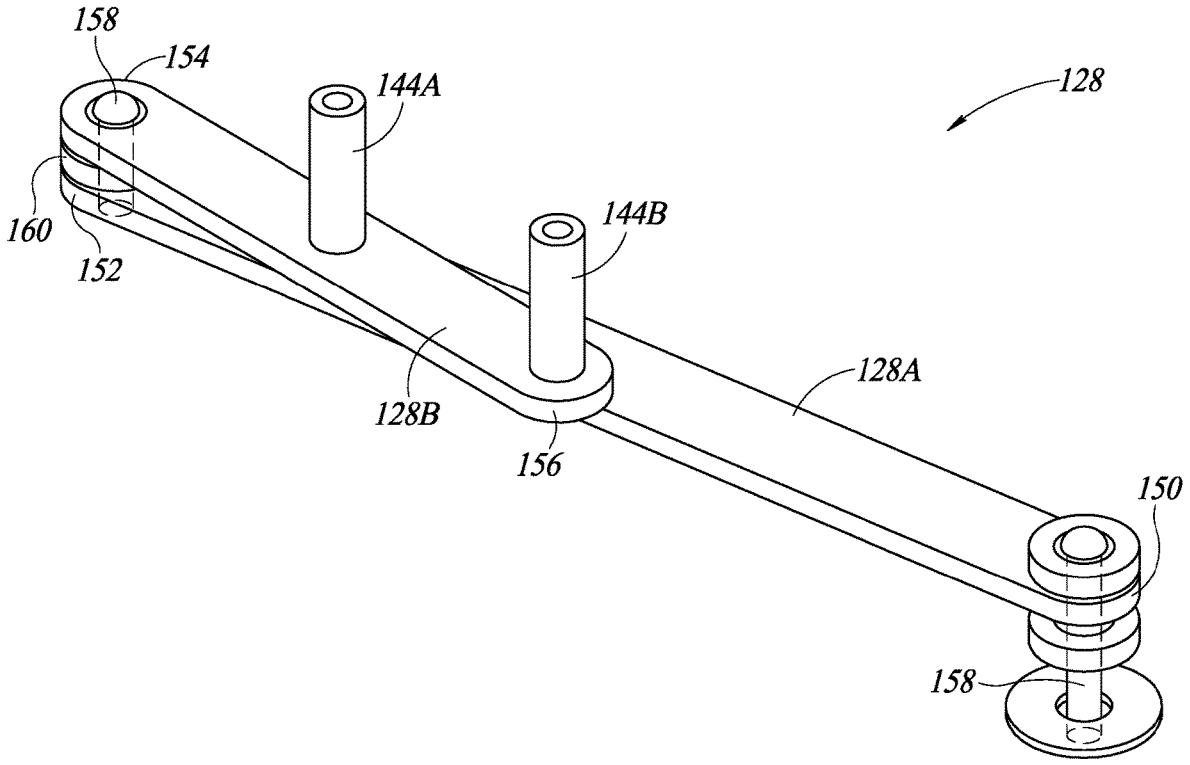
FIG. 5 is an isometric view of a pivot of the storage cabinet of FIG. 1.
Figure 6A:
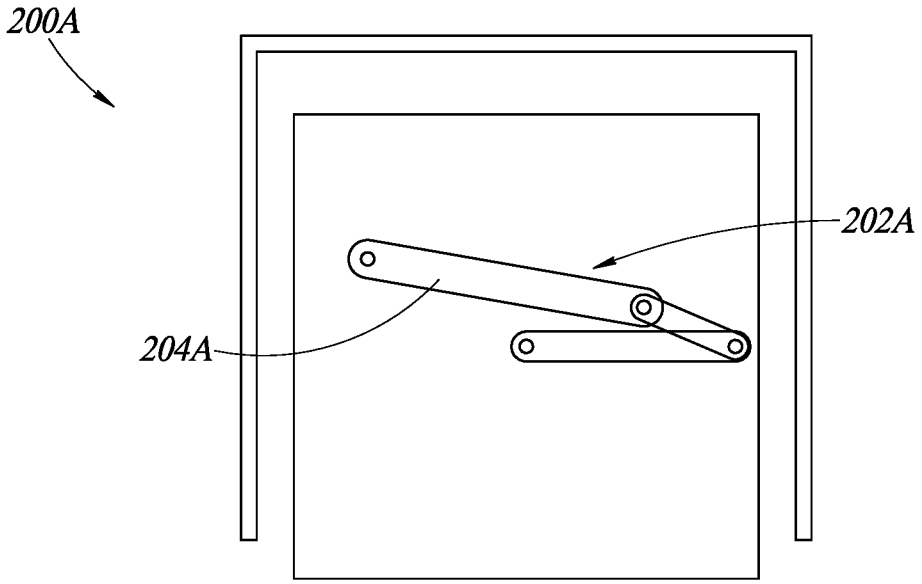
FIGS. 6A-6F are schematic views of embodiments of a pivot of a storage cabinet according to the present disclosure.
Figure 6B:
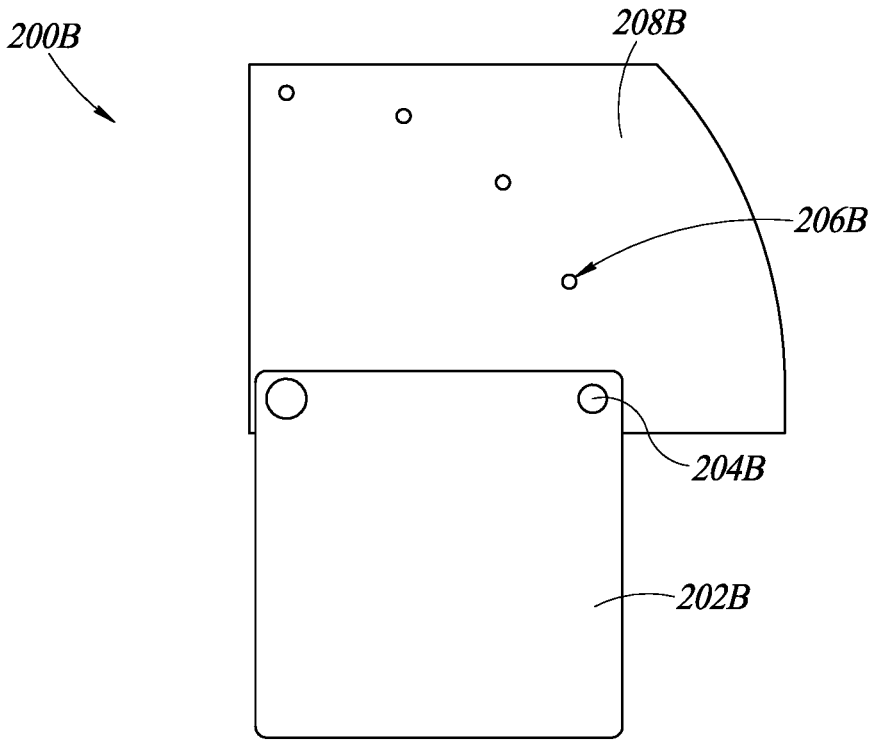
Figure 6C:
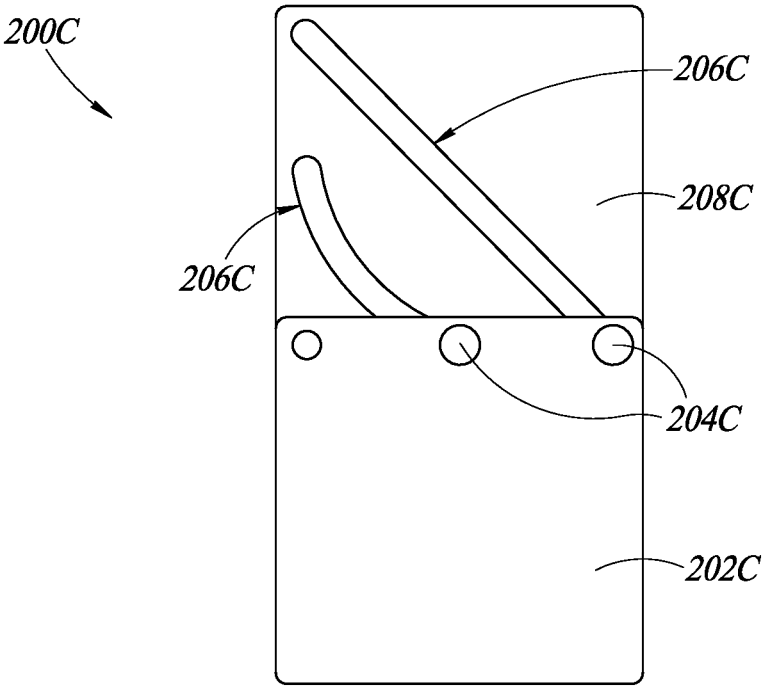
Figure 6D:
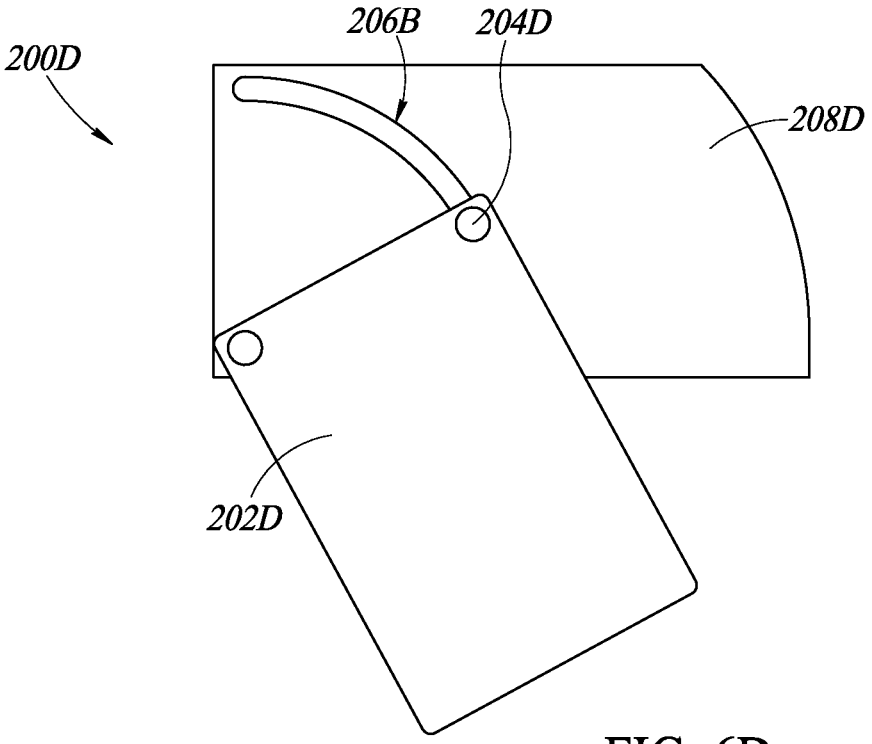
Figure 6E:
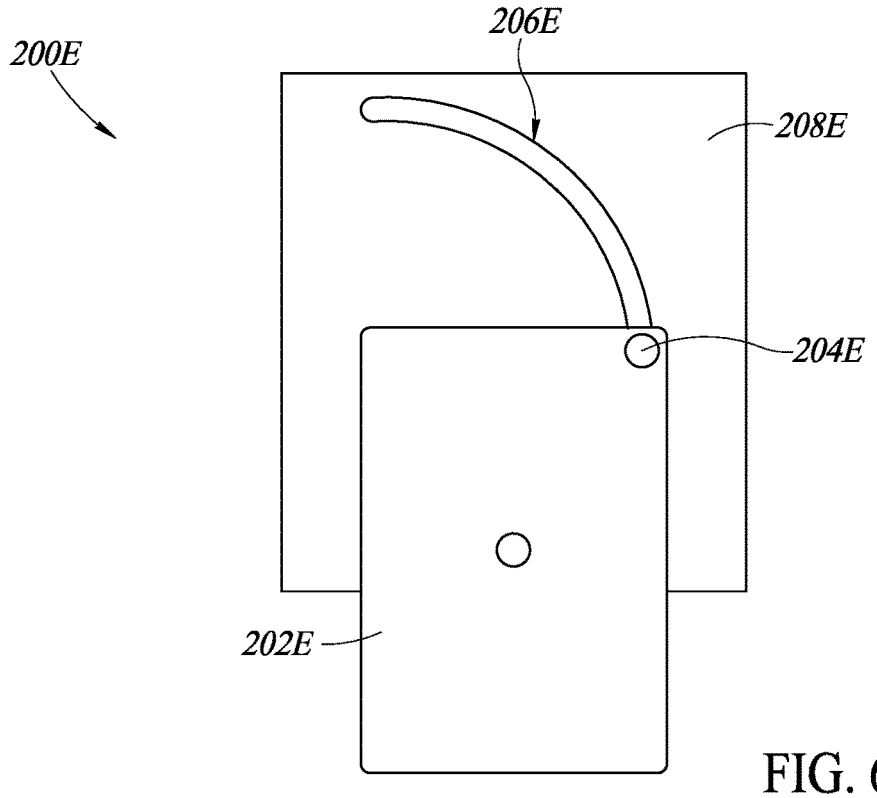
Figure 6F:
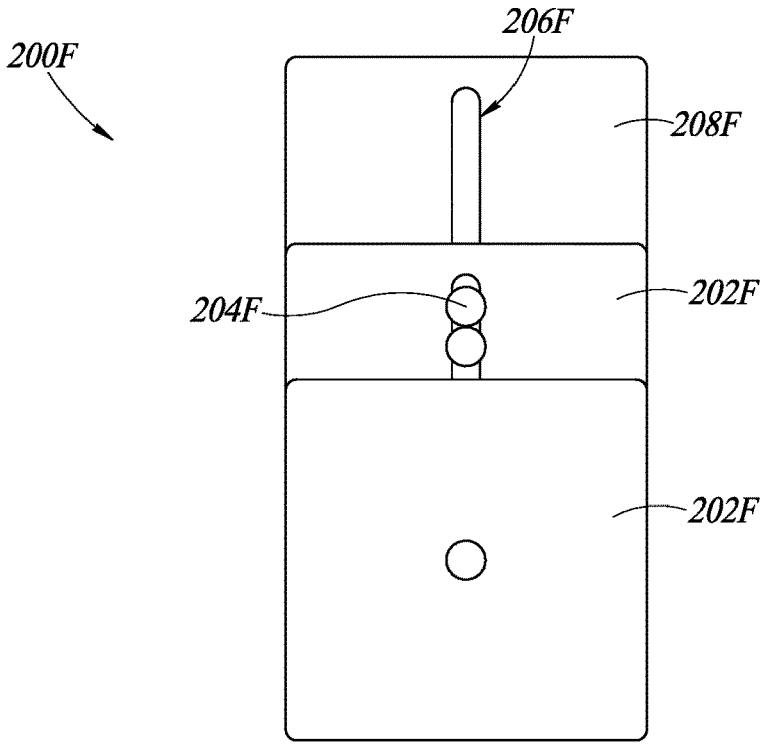

FIG. 5 is an isometric view of one or more embodiments of the pivot 128. The pivot 128 may include the two pivot arms 128A, 128B with each pivot arm 128A, 128B provided in a form factor of a generally flat and planar metal link in some embodiments. The first pivot arm 128A includes a first end 150 and a second end 152 opposite to the first end 150. The second pivot arm 128B likewise includes a first end 154 and a second end 156 opposite to the first end 154. The first pivot arm 128A has a length between its first and second ends 150, 152 that is greater than a length of the second pivot arm 128B between its first and second ends 154, 156 in some embodiments, although the length of each of the pivot arms 128A, 128B may be selected to be different. The first end 150 of the first pivot arm 128A is coupled to the housing 102, and more specifically, to the bottom interior surface 110 of the housing 102 (FIG. 1). The second end 152 of the first pivot arm 128A is rotatably coupled to the first end 154 of the second pivot arm 128B. As noted above, the first and second extensions 144A, 144B on the second arm 128B may be coupled to an underside of the turntable 140 (FIG. 3A). Such connections may be facilitated by fasteners 158, which may be screws, bolts, and the like, that enable fixed mechanical couplings and/or rotation.

In some embodiments, the second extension 144B is positioned proximate (i.e., within 0.25 inches in this context only) to an outer peripheral edge of the second pivot arm 128B at the second end 156 of the second pivot arm 128B. The first extension 144A may be positioned between the first and second ends 154, 156 of the second pivot arm 128B and in some embodiments, proximate a center of the second pivot arm 128B. The extensions 144A, 144B may be provided in a form factor of a tube extending away from the second pivot arm 128B that is structured to receive a fastener 158 to facilitate coupling the extensions 144A, 144B to the turntable 140. Further, the second pivot arm 128B may be spaced from the first pivot arm 128A by at least a spacer or washer 160 to prevent the pivot arms 128A, 128B from interfering with each other during movement of the pivot 128 and to further assist with movement of the pivot 128.

Other variations for the pivot 128 are contemplated herein, and shown schematically in FIGS. 6A-6F. For example, in an embodiment of a storage cabinet 200A shown in FIG. 6A, a pivot 202A may include more than two pivot arms, such as at least three pivot arms 204A. Each of the pivot arms 204A may have the same or a different length and may generally be connected to each other and to aspects of the cabinet 200A as described with reference to pivot 128 and FIG. 5. In an embodiment of a cabinet 200B shown in FIG. 6B, a pivot 202B may include a pin 204B that is received in a series of holes 206B in a turntable or drawer 208B. The holes 206B may be arranged in a generally curved shape or arrangement corresponding to an amount of rotation of aspects of the cabinet 200B. In an embodiment of a storage device 200C, a pivot 202C may include pins or extensions 204C that are received in corresponding channels 206C in a turntable or drawer 208C. A first one of the channels 206C may be curved and have a radius of curvature that corresponds to rotation of certain aspects of the storage device 200C, while the other channel 206C is straight and rectilinear to provide further support to aspects of the pivot 202C.

In an embodiment of a storage cabinet 200D, a pivot 202D may include only a single arm that includes a guide member 204D received in a curved channel 206B in a drawer or turntable 208D according to the concepts of the disclosure. The curved channel 206B may have a radius of curvature between and including 45 degrees to 60 degrees. A storage cabinet 200E shown in FIG. 6E may have a similar arrangement to the cabinet 200D of FIG. 6D, such as a pivot 202E with a single arm and an extension 204E received in a curved slot 206E in a turntable or drawer 208E. However, the curved slot 206E has a radius of curvature of 90 degrees or approximately 90 degrees, as in other embodiments described herein. Accordingly, the cabinet 200E of FIG. 6E may be similar to storage cabinet 100 shown and described with reference to FIGS. 1-5, except the pivot 202E includes a single arm. In an embodiment of a storage cabinet 200F, the cabinet 200F may include a pivot 202F that includes two arms and one or more extensions 204F that travel along a straight and rectilinear guide slot 206F in a drawer or turntable 208F. As a result, at least some embodiments of the storage cabinets herein, including at least cabinet 200F, are not configured for rotational motion, but rather, contemplate linear movement to achieve at least some of the advantages described herein.

Figure 7:
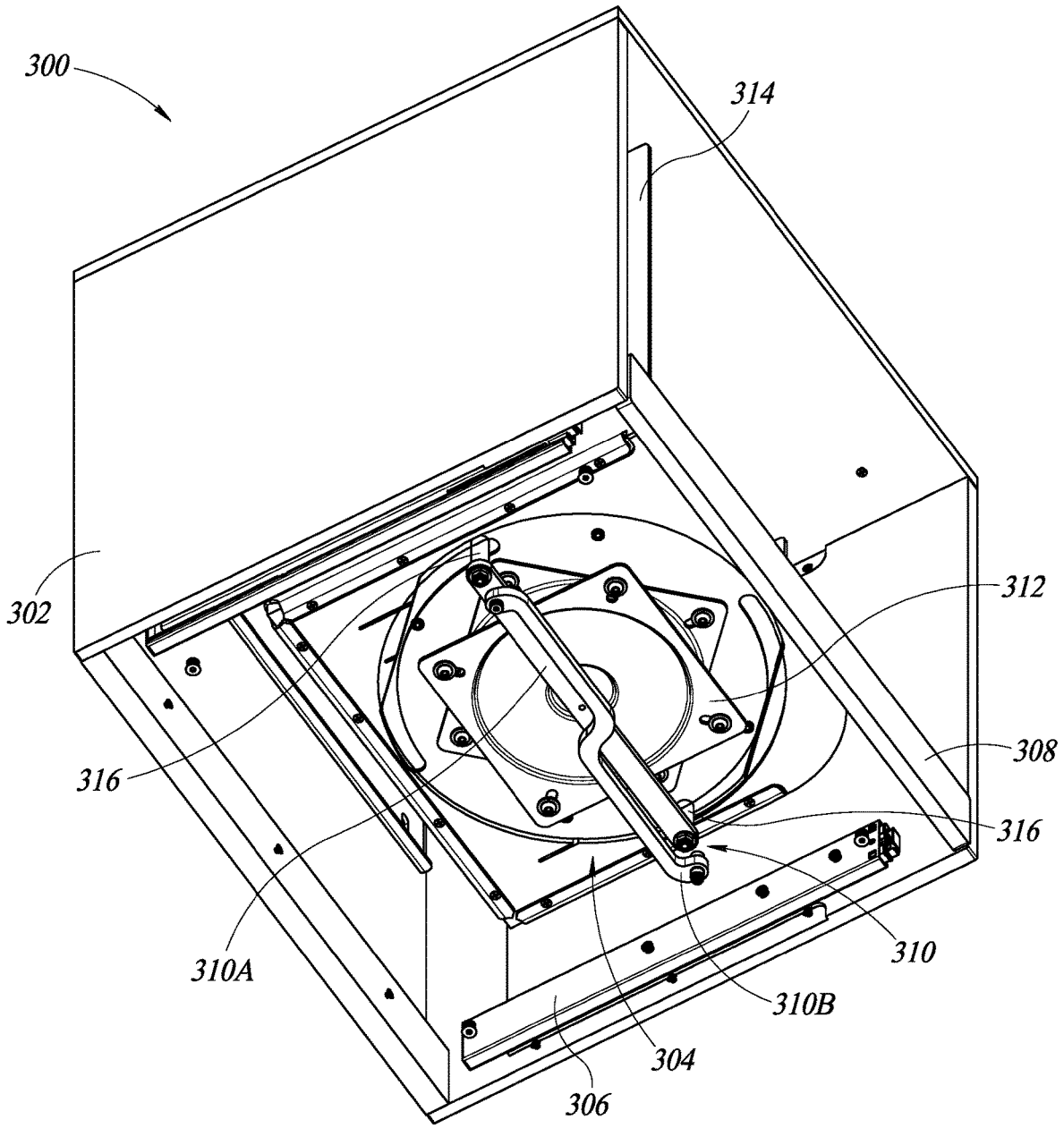
FIG. 7 is a cross-sectional view of an embodiment of a storage cabinet according to the present disclosure.

Further configurations of the storage cabinet are contemplated herein. For example, FIG. 7 is a cross-sectional view of an embodiment of a storage cabinet 300 according to the present disclosure. The cabinet 300 may be similar to the cabinet 100 described herein, except as otherwise indicated. The cross section in FIG. 7 is taken along a bottom end 302 of the storage cabinet 300 to expose a rotation assembly 304. FIG. 7 also provides another example of drawer slides 306 coupled to a drawer 308 to enable linear motion of the drawer 308. The rotation assembly 304 includes a pivot 310 with a first arm 310A and a second arm 310B, as well as a turntable 312 and a tray 314 coupled to the turntable 312. The first arm 310A of the pivot 310 is coupled to the tray 314 at both opposite ends of the first arm 310A via extensions 316, with the tray 314 placed on the turntable 312 to reduce friction during rotation of the tray 314. The second arm 310B includes a first end fixedly coupled to the storage cabinet 300, such as to a bottom plate of the storage cabinet 300 that is not shown in FIG. 7. A second, opposite end of the second arm 310B is rotatably coupled to the first arm 310A near, or adjacent to, one end of the first arm 310A and offset from a center of the first arm 310A. As a result, when the drawer 308 slides out of the cabinet 300, the arms 310A, 310B extend, which moves the extensions 316 and results in rotation of the tray 314. Thus, embodiments of the disclosure include the rotation assembly 304 having two arms 310A, 310B and two extensions 316 coupled to the tray 314 (or the turntable 312, or both, in some embodiments) on opposite outer sides of the tray 312 instead of a location proximate a middle of the tray 312 as in the previous examples.

Figure 8A:
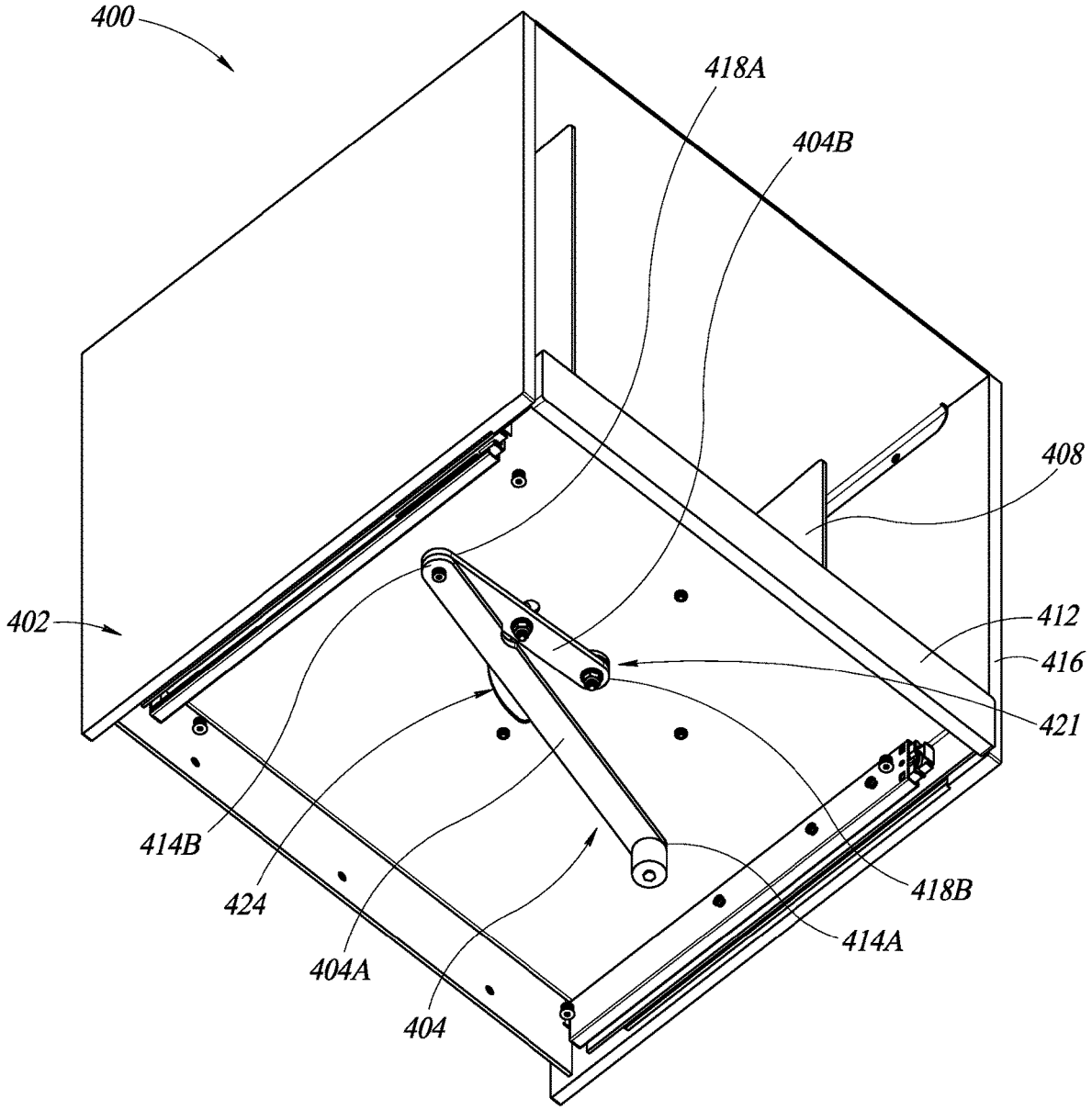
FIG. 8A-8C are cross-sectional views of an embodiment of a storage cabinet illustrating a rotation assembly at a bottom of the storage cabinet.
Figure 8B:
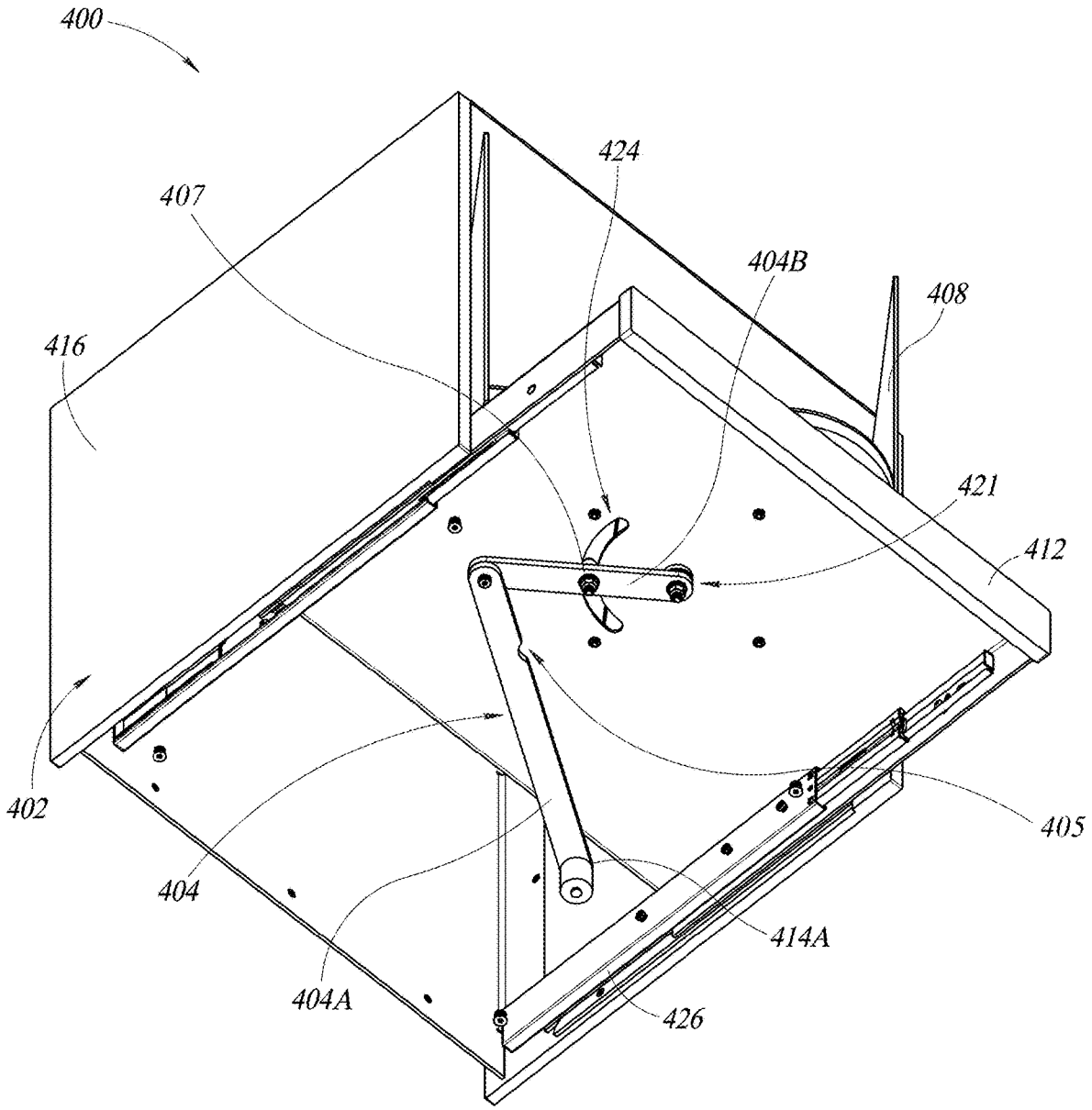
Figure 8C:
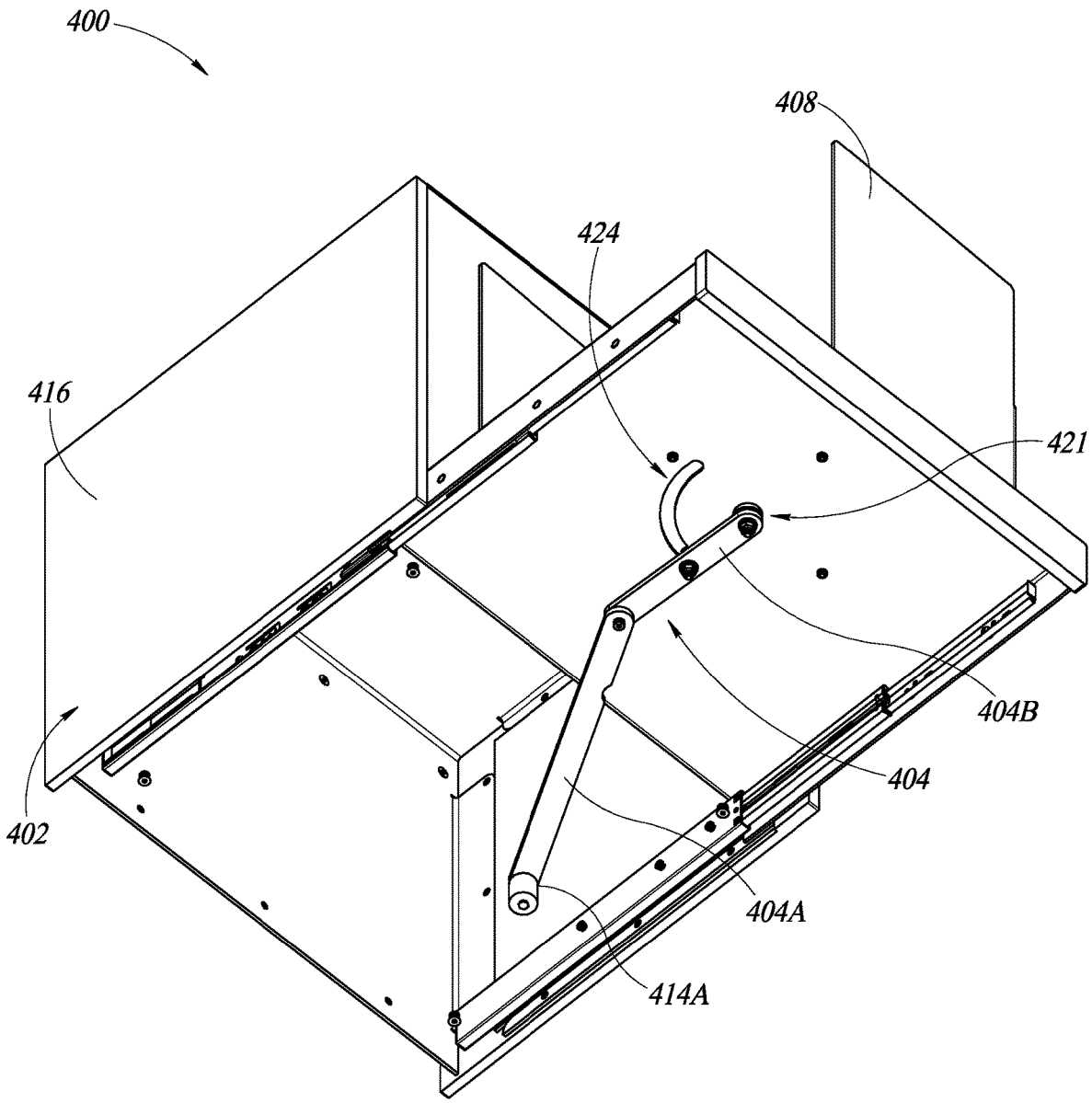
Figure 9:
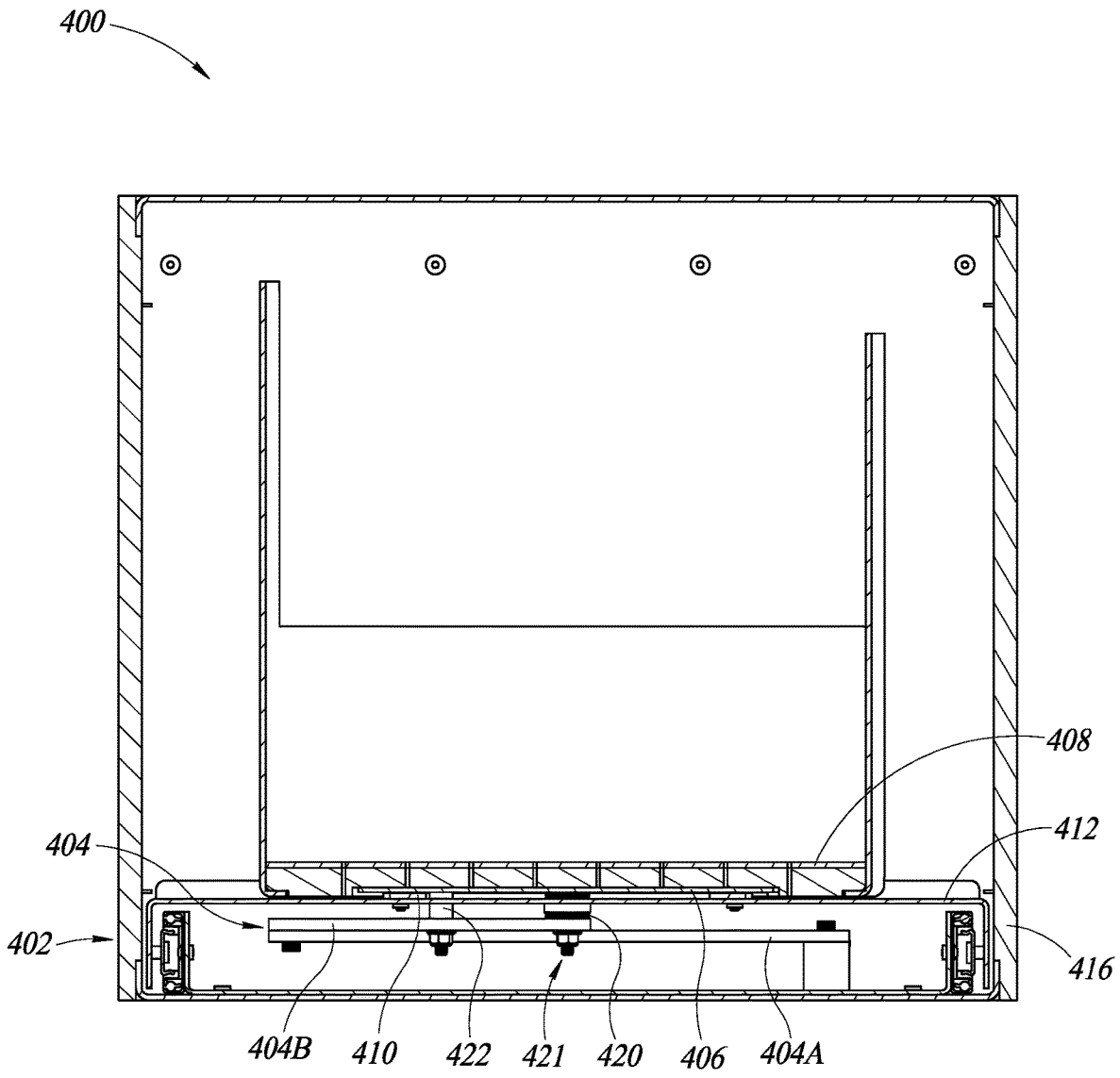
FIG. 9 is a front cross-sectional view of the storage cabinet of FIG. 8A.

FIG. 8A-8C are cross-sectional views of an embodiment of a storage cabinet 400 in fully retracted, partially extended, and fully extended configurations, respectively, taken at a bottom end 402 of the storage cabinet 400. FIG. 9 is a front cross-sectional view of the storage cabinet 400. The storage cabinet 400 may be similar to the cabinets 100, 300 described herein, except as otherwise noted below. In some embodiments, the storage cabinet 400 may omit a separate turntable or lazy susan assembly. For example, with reference to FIG. 8A and FIG. 9, the storage cabinet 400 may include a rotation assembly that includes a link assembly 404 coupled to a rotation plate 406. The link assembly 404 includes first and second links 404A, 404B (which may also be referred to herein as arms 404A, 404B) and the rotation plate 406 is coupled to a tray 408 of the storage cabinet 400. In an embodiment, a ring plate or washer 410 may be disposed between the rotation plate 406 and a drawer 412 of the cabinet 400. Further, the rotation plate 406 may be rotatably coupled to the drawer 412 via the ring plate 410. In some examples, the ring plate 410 is instead a bearing assembly or some other like device described herein to assist with rotation of the rotation plate 406 relative to the drawer 412.

The first link 404A includes a first end 414A fixedly coupled to a housing 416 of the cabinet 400, which may be a bottom cover plate of the housing 416 in some embodiments, and a second opposite end 414B. The second link 404B includes a first end 418A rotatably coupled to the second end 414B of the first link 404A and a second opposite end 418B that is rotatably coupled to the rotation plate 406. In an embodiment, the coupling between the second end 418B of the second link 404B and the rotation plate 406 includes bearings 420, or other rollers, wheels, and the like such that the coupling between the second end 418B of the second link 404B and the rotation plate 406 is a pivot point 421. In an embodiment, the pivot point 421 includes bearings 420 between the second link 404B and the drawer 412 and bearings 420 between the drawer 412 and the rotation plate 406. The second link 404B further includes an extension 422 that is coupled to the rotation plate 406 through an opening 424 through the drawer 412 of a selected size and shape.

Turning to FIG. 8B and FIG. 8C, as the drawer 412 extends from the housing 416 via drawer slide assemblies 426, the fixed and rotatably coupled ends of the link assembly 404 (i.e., first end 414A of first link 404A and pivot point 421) cause the links 404A, 404B to unfold and extend relative to each other, which changes a position of the extension 422 (FIG. 9) of the second link 404B or moves the extension 422. The change in position of the extension 422, which is coupled to the rotation plate 406 (FIG. 9), results in rotation of the rotation plate 406 and the tray 408 coupled to the rotation plate 406. As such, embodiments of the disclosure contemplate a storage cabinet that produces rotational motional of a tray on a drawer of the cabinet without a lazy susan or turntable to reduce complexity and manufacturing cost, among other benefits. The first link 404A includes a notch 405 configured to receive a fastener 407 of the extension 422 of the second link 404B in response to the drawer 412 being in a retracted position.

In view of the above, storage cabinets are provided that enable a user to view two sides or surfaces of an item stored in the cabinet. Such an arrangement may be particularly advantageous where the two sides or surfaces have different features or identifying features. In non-limiting examples where the item stored in the cabinet is a protective sleeve for a vinyl record, the concepts of the disclosure enable a traditional storage configuration with the spines facing outward while also rotating to present a front surface to display cover artwork. The concepts of the disclosure therefore also advantageously enable, in addition to traditional storage, users to view the cover artwork on the front surface and flip through records much in the same way as they would at a record shop. The cabinets described herein are modular and can be stacked or otherwise arranged to further increase storage capacity in an overall visually clean and modern aesthetic.

In the above description, certain specific details are set forth in order to provide a thorough understanding of various embodiments of the disclosure. However, one skilled in the art will understand that the disclosure may be practiced without these specific details. In other instances, well-known structures associated with the technology have not been described in detail to avoid unnecessarily obscuring the descriptions of the embodiments of the present disclosure.

Certain words and phrases used in the specification are set forth as follows. As used throughout this document, including the claims, the singular form "a", "an", and "the" include plural references unless indicated otherwise. Any of the features and elements described herein may be singular, e.g., a die may refer to one die. The terms "include" and "comprise," as well as derivatives thereof, mean inclusion without limitation. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Other definitions of certain words and phrases are provided throughout this disclosure.

The use of ordinals such as first, second, third, etc., does not necessarily imply a ranked sense of order, but rather may only distinguish between multiple instances of an act or a similar structure or material.

Throughout the specification, claims, and drawings, the following terms take the meaning explicitly associated herein, unless the context clearly dictates otherwise. The term "herein" refers to the specification, claims, and drawings associated with the current application. The phrases "in one embodiment," "in another embodiment," "in various embodiments," "in some embodiments," "in other embodiments," and other derivatives thereof refer to one or more features, structures, functions, limitations, or characteristics of the present disclosure, and are not limited to the same or different embodiments unless the context clearly dictates otherwise. As used herein, the term "or" is an inclusive "or" operator, and is equivalent to the phrases "A or B, or both" or "A or B or C, or any combination thereof," and lists with additional elements are similarly treated. In addition, throughout the specification, the meaning of "a," "an," and "the" include singular and plural references.

Generally, unless otherwise indicated, the materials for making the invention and/or its components may be selected from appropriate materials such as composite materials, ceramics, plastic or plastic compounds, metal, polymers, wood, cardboard, wood laminates or composites, wood veneers on any such materials, and the like.

The foregoing description, for purposes of explanation, uses specific nomenclature and formula to provide a thorough understanding of the disclosed embodiments. It should be apparent to those of skill in the art that the specific details are not required in order to practice the invention. The embodiments have been chosen and described to best explain the principles of the disclosed embodiments and its practical application, thereby enabling others of skill in the art to utilize the disclosed embodiments, and various embodiments with various modifications as are suited to the particular use contemplated. Thus, the foregoing disclosure is not intended to be exhaustive or to limit the invention to the precise forms disclosed, and those of skill in the art recognize that many modifications and variations are possible in view of the above teachings.

The terms "top," "bottom," "upper," "lower," "left," "right," and other like derivatives are used only for discussion purposes based on the orientation of the components in the Figures of the present disclosure. These terms are not limiting with respect to the possible orientations explicitly disclosed, implicitly disclosed, or inherently disclosed in the present disclosure and unless the context clearly dictates otherwise, any of the aspects of the embodiments of the disclosure can be arranged in any orientation.

As used herein, the relative terms "substantially," "approximately," and other like derivatives are construed to include an ordinary error range or manufacturing tolerance due to slight differences and variations in manufacturing. Except as otherwise indicated, such ordinary error range or manufacturing tolerance includes a value, amount, quantity, or dimension, that is within plus or minus 5% of the stated value, amount, quantity, or dimension. It is to be further understood that any specific dimensions of components or features provided herein are for illustrative purposes only with reference to the various embodiments described herein, and as such, it is expressly contemplated in the present disclosure to include dimensions that are more or less than the dimensions stated, unless the context clearly dictates otherwise.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet, including U.S. Provisional Application No. 63/247,311, filed Sep. 23, 2021, are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the breadth and scope of a disclosed embodiment should not be limited by any of the above-described embodiments, but should be defined only in accordance with the following claims and their equivalents.

The invention claimed is:

1. A device, comprising:

a support;

a drawer coupled to the support and configured to slide relative to the support;

a curved opening through the drawer;

a tray disposed on the drawer; and a pivot including a first link coupled to the support and a second link rotatably coupled to the first link, the second link coupled to the tray at two different locations to establish a pivot point for rotational movement of the tray, the pivot having an extension coupled to the tray through the curved opening with the extension corresponding to a first one of the two different locations, and wherein the tray is configured to rotate in response to any linear movement of the drawer relative to the support over an entire path of travel of the drawer via movement of the extension of the pivot along the curved opening.

2. The device of claim 1, wherein the first link is fixed to the support.

3. The device of claim 2, wherein the first link has a length greater than a length of the second link, and wherein the second link is coupled to a center of the tray corresponding to a second one of the two different locations and the extension is located along the second link between an interface between the second link and the tray and an interface between the first link and the second link, the extension offset from the center of the tray.

4. The device of claim 1, wherein the tray rotates approximately 90 degrees over the entire path of travel of the drawer relative to the support, and wherein the curved opening is curved over its entire length.

5. The device of claim 1, wherein the tray includes a first arm and a second arm opposite to the first arm, the first arm and the second arm spaced from an interior surface of the support to accommodate rotational motion of the tray on the support, and wherein the first link is coupled to the support on an opposite side of the support from the extension of the second link and the curved opening through the drawer.

6. The device of claim 1, further comprising:

a plurality of rolling elements between the pivot and the tray, the plurality of rolling elements including rollers, wheels, or ball bearings, and wherein the first link includes a notch configured to receive a fastener of the extension of the second link in response to the drawer being in a retracted position.

7. The device of claim 1, wherein the drawer is configured to slide from a retracted position on the support to a fully extended position extending from the support in response to only an initial force on the drawer by a user.

8. A device, comprising:

a base;

a drawer structured for linear movement relative to the base;

a tray disposed on the drawer; and a pivot coupled to the base and to the tray, the pivot configured to rotate the tray about a vertical axis in response to initial linear movement of the drawer away from the base, the pivot including a first pivot arm and a second pivot arm, the first pivot arm coupled to the base and the second pivot arm rotatably coupled to the first pivot arm, the second pivot arm coupled to the tray at two different locations to establish a pivot point for rotational movement of the tray in response to any linear movement of the drawer.

9. The device of claim 8, wherein the second pivot arm further includes an extension coupled to the tray through a curved opening in the drawer, the curved opening and the extension being offset from a center of the tray, the device further comprising:

a rotation plate between the tray and the drawer, the tray coupled to the rotation plate and the rotation plate coupled to the second pivot arm at the pivot point and to the extension of the second pivot arm.

10. The device of claim 9, wherein the extension of the second pivot arm is spaced from both opposite outermost ends of the second pivot arm.

11. The device of claim 9, wherein the curved opening is curved over its entire length and the extension is configured to travel along the curved opening to induce rotational movement of the tray in response to any linear movement of the drawer.

12. The device of claim 8, further comprising:

at least one rotation support at an interface between the second pivot arm and the tray, the at least one rotation support including at least one of a roller, a wheel, and a ball bearing, wherein the two different locations where the second pivot arm is coupled to the tray include:

an outermost end of the second pivot arm opposite from an interface between the first pivot arm and the second pivot arm; and a location between the outermost end and the interface between the first pivot arm and the second pivot arm.

13. The device of claim 8, wherein the tray includes a first arm and a second arm both configured to rotate with the tray, the first arm and the second arm extending perpendicular to the tray and spaced from each other on opposite sides of the tray to define an internal volume between the arms for holding at least one flat and planar object.

14. The device of claim 8, wherein the pivot is configured to rotate the tray between and including 75 degrees and 105 degrees over a full range of the linear movement of the drawer via a curved opening in the drawer offset from the pivot point and an extension of the second pivot arm that is coupled to the tray through the opening, and wherein the extension is coupled to the tray on an opposite side of the base from where the first pivot arm is coupled to the base.

15. A device, comprising:

a support;

a drawer coupled to the support, the drawer configured for linear movement relative to the support;

a tray on the drawer; and a pivot including a first link and a second link rotatably coupled to the first link, the first link coupled to the support and the second link coupled to the tray at two different locations to establish a pivot point for rotational movement of the tray, the second link further including an extension coupled to the tray through an opening in the drawer corresponding to a first one of the two different locations, the extension located along the second link between a second one of the two different locations and an interface between the first link and the second link, wherein the first link and the second link are configured to move relative to each other in response to linear movement of the drawer with movement of the second link changing a position of the extension and generating rotational motion of the tray about a vertical axis, wherein the extension of the second link is configured to rotate the tray in response to any linear movement of the drawer.

16. The device of claim 15, further comprising:

a turntable coupled to the tray and the extension of the pivot coupled to the turntable and configured to rotate the turntable in response to any linear movement of the drawer, wherein the second one of the two different locations is at a center of the tray and the extension is spaced from both opposite outermost ends of the second link.

17. The device of claim 15, wherein the drawer includes a plate having the opening and the opening is curved over its entire length to induce rotational movement of the tray in response to any linear movement of the drawer.

18. The device of claim 15, wherein the tray includes a pair of arms extending perpendicular to the tray on opposite sides of the tray to define an internal volume that is configured to receive at least one item, a minor surface of the at least one item facing outward and away from the drawer in an initial position of the drawer, and a major surface of the at least one item facing outward and away from the drawer in response to the drawer being extended from the support, and wherein the first link and the second link are configured to move relative to each other in response to only linear movement of the drawer with movement of the second link changing the position of the extension and generating rotational motion of the tray about the vertical axis in response to only the linear movement of the drawer.

19. The device of claim 15, wherein the tray is configured to rotate in response to initial linear movement of the drawer, and wherein the opening is an arcuate opening corresponding to one quarter of a circle including the arcuate opening such that the tray is configured to rotate approximately 90 degrees as the extension moves along the arcuate opening.

20. The device of claim 15, wherein the extension is configured to rotate the tray simultaneously with linear movement of the drawer over an entire path of travel of the drawer, and wherein the first link is directly coupled to the support on an opposite side of the support from the opening through the drawer, the opening through the drawer located closer to the pivot point than a location where the first link is directly coupled to the support.

* * * * *